US005269451A

United States Patent [19]

Udagawa et al.

[11] Patent Number: 5,269,451

[45] Date of Patent: Dec. 14, 1993

[54] ELECTRIC STAPLER WITH UNMOVABLY FIXED MAGAZINE

[75] Inventors: Hiroshi Udagawa; Kunio Ishizaki; Katsunori Manabe, all of Tokyo, Japan

[73] Assignee: Max Co., Ltd., Tokyo, Japan

[21] Appl. No.: 759,533

[22] Filed: Sep. 13, 1991

[30] Foreign Application Priority Data

| | | | |
|---|---|---|---|
| Sep. 14, 1990 | [JP] | Japan | 2-96625 |
| Sep. 14, 1990 | [JP] | Japan | 2-245695 |
| Sep. 14, 1990 | [JP] | Japan | 2-245696 |
| Jan. 17, 1991 | [JP] | Japan | 3-4724 |
| Jan. 17, 1991 | [JP] | Japan | 3-4725 |
| Jan. 17, 1991 | [JP] | Japan | 3-4726 |

[51] Int. Cl.[5] ..... B27F 7/17

[52] U.S. Cl. ..... 227/120; 227/129; 227/136; 227/155

[58] Field of Search ..... 227/120, 125, 127, 129, 227/131, 135, 136, 155

[56] References Cited

U.S. PATENT DOCUMENTS

| | | | |
|---|---|---|---|
| 2,328,983 | 9/1943 | La Place | 227/125 |
| 2,770,805 | 11/1956 | Elzer et al. | 227/131 |
| 3,026,518 | 3/1962 | Oussani | 227/120 |
| 3,279,673 | 10/1966 | Schafroth et al. | 227/136 |
| 3,622,061 | 11/1971 | Hoyer et al. | 227/131 |
| 4,199,095 | 4/1980 | Yamanoi | 227/125 |
| 4,623,082 | 11/1986 | Kurosawa | 227/131 |
| 4,809,898 | 3/1989 | Gassner et al. | 227/125 |
| 4,993,616 | 2/1991 | Yoshie et al. | 227/131 |
| 5,009,355 | 4/1991 | Akizawa et al. | 227/131 |

FOREIGN PATENT DOCUMENTS

| | | |
|---|---|---|
| 0366094 | 5/1990 | European Pat. Off. . |
| 61-76312 | 4/1986 | Japan . |
| 61-112873 | 7/1986 | Japan . |
| 62-79977 | 4/1987 | Japan . |
| 62-255080 | 11/1987 | Japan . |
| 62-255082 | 11/1987 | Japan . |
| 63-38982 | 3/1988 | Japan . |
| 63-120086 | 5/1988 | Japan . |
| 63-34854 | 9/1988 | Japan . |
| 64-23374 | 2/1989 | Japan . |
| 1-60880 | 4/1989 | Japan . |
| 1-25670 | 5/1989 | Japan . |
| 1-26825 | 5/1989 | Japan . |
| 1-74076 | 5/1989 | Japan . |
| 1-84981 | 6/1989 | Japan . |
| 1-87330 | 6/1989 | Japan . |
| 2-18201 | 4/1990 | Japan . |
| WO8101983 | 4/1987 | World Int. Prop. O. . |
| WO8706871 | 11/1987 | World Int. Prop. O. . |

*Primary Examiner*—Frank T. Yost
*Assistant Examiner*—Scott A. Smith
*Attorney, Agent, or Firm*—Cushman, Darby & Cushman

[57] ABSTRACT

An Electric stapler of the type in which a magazine is unmovably fixed, characterized in that the magazine is secured to a body frame; a driver for driving out a staple is supported by the magazine so that the driver can be rectilinearly reciprocated; a clincher, which receives the staple driven out by the driver, is supported by the frame so that the clincher is located to face the driver and can be reciprocated on the production of the direction of the reciprocation of the driver; the driver is coupled to drive links at one end of each thereof; the links are supported by the frame so that the links are swingable; the clincher is coupled to a clincher lever at one end thereof; the lever is supported by the frame so that the lever is swingable; the links and the lever are associated at the other ends thereof with a drive control cam, which is rotated by an electric motor; and the driver and the clincher are nearly simultaneously moved toward and away from each other in mutually opposite directions through the rotation of the cam.

2 Claims, 18 Drawing Sheets

ELECTRIC STAPLER WITH UNMOVABLY FIXED MAGAZINE

BACKGROUND OF THE INVENTION

The present invention relates to an electric staple in which a magazine in unmovably fixed to a body frame so that a driver for driving out a staple is rectilinearly moved.

There is a type of an electric stapler in which a magazine is pivotally coupled to a body frame so as to be swingable, as disclosed in the Japanese Patent examined Publications Nos. 26825/89 and 25670/89. Since a driver is swung together with the magazine, the driver is moved along an arc relative to a clincher so that the direction of driving-out of a staple is not coincident with the center line of the clincher. For that reason, a stapling failure or the like is likely to occur, and high motive power is needed for swinging the magazine. This is a problem.

There is another type of an electric stapler in which a magazine is unmovably fixed to a body frame, as disclosed in the Japanese Patent Examined Publication No. 18201/90. The distance between the staple drive-out opening of the magazine and a clincher is fixed. As a result, if the thickness of a stapled material is small, the distance between the opening and the stapled material is so large that a staple driven out of the magazine is not supported at the legs of the staple until the points of the legs reach the material. For that reason, the staple is likely to tilt to undergo buckling resulting in a stapling failure. This is a problem.

There is yet another type of an electric stapler in which the swing of a clincher is synchronized with that of a magazine by a mechanism so that the drive out opening of a magazine and the clincher are always kept on an imaginary line, as disclosed in the Japan Utility Model Application (OPI) Nos. 23374/89 and 84981/89 (the term "OPI" as used herein means an "unexamined published application"). Since the magazine and a staple driver are moved together at the time of driving out a staple, a means by which staples in a cartridge are held not to sway at the time of the swing of the magazine needs to be provided if the cartridge is disposed on the magazine. This is a problem.

A first aspect of the present invention was made in order to solve the problems mentioned above. Accordingly, it is an object of the invention to provide an electric stapler of the magazine unmovable fixation type, which does not need high motive power and operates so that the legs of a staple are quickly supported after the driving-out thereof to prevent the staple from undergoing wrong clinching such as buckling, and wherein a staple sheet does not sway in a cartridge.

The present device of a second aspect of the present invention relates to a staple sheet feeder which is for an electric stapler which functions so that staple sheets stacked together in a cartridge are sequentially moved therefrom and fed to the prescribed position.

As for a conventional electric stapler of the type in which the straight staples of a staple sheet consisting of the straight staples conjoined together are sequentially formed as U and then driven out of the stapler, starting with the foremost of the staples, the staple sheet needs to be fed from a prescribed position to the forming and drive-out portion of the stapler. For such feeding, a number of feeders were developed as disclosed in the Japan Patent Application (OPI) Nos. 79977/87 and 120086/88 (the term "OPI" as used herein means an "unexamined published application").

In one of the feeders, a feed claw is engaged with a staple sheet and swung so that staples are fed sequentially. Since the length of the feed of the staple sheet by the feed mechanism of the feeder needs to be set to correspond to the size of a single staple, the processed components of the feeder and the assembly and maintenance of the components are required to be accurate. This is a problem.

In another of the feeders, a staple sheet is continuously fed by an endless belt as described in the Japanese Patent Applications (OPI) Nos. 76312/86 and 255080/87. Since the feeder does not have a means for modulating the frictional force between the endless belt and the staple sheet in a cartridge, it is necessary to adjust both the cartridge housing portion of a magazine and the component of an endless belt running means to each other in their assembly so as to present an optimal frictional force between the endless belt and the staple sheet. This is a problem. There is another problem in that the endless belt is likely to be relatively much worn.

The present device of the second aspect of the present invention was made in order to solve the problem mentioned above. Accordingly, it is an object of the invention to provide a staple sheet feeder which is for an electric stapler and by which a staple sheet can be smoothly and securely fed without using an accurate component and performing the adjustment thereof in assembly.

The present device of a third aspect of the present invention relates to a staple sheet detector which is for an electric stapler housing staple sheets stacked together in a cartridge so as to be sequentially moved out of the cartridge and fed to the front of magazine and finds out whether the staple sheets are already all moved out of the cartridge.

As for a conventional electric stapler of the type in which a staple sheet consisting of straight staples conjoined together is formed as U at each staple and the staple is then driven out from the stapler, the staple sheets are stacked together in a cartridge and the cartridge is then fitted to a magazine. After the staple is moved out of the fitted cartridge to the forming front portion of the magazine by a feeder, the foremost staple of the sheet is formed as U and then driven out into a stapled material. To prevent the stapler from performing such staple driving-out operation without the staple, a staple sheet detector for finding out whether the staple sheet is in the cartridge or not, as disclosed in the Japan Utility Model Application (OPI) No. 112873/86 (the term "OPI" as used herein means an "unexamined published application"). The staple sheet detector is made of a reflection-type photosensor provided in such a position as to face the lowermost staple sheet. The fact that light for the photosensor is not reflected by the staple sheet if the sheet is not in the cartridge is utilized for the staple sheet detector to find out whether there is a staple sheet in the cartridge. However, the photosensor is expensive, and the reflectance of the surface of the staple sheet is nonuniform to make the photosensor likely to operate wrongly This is a problem.

The present device of the third aspect of the present invention was made in order to solve the problem mentioned above. Accordingly, it is an object of the device to provide a staple sheet detector for finding out whether there is a stable sheet in a cartridge in an electric stapler.

The present device of a fourth aspect of the present invention relates to a mechanism for fixing a stable sheet housing cartridge to an electric stapler of the type in which a staple sheet is partly bent as U and a staple is then driven out.

Arts, in each of which a cartridge of such kind is fitted to the magazine of an electric stapler, were disclosed in the Japan Patent Application (OPI) No. 255082/87 and the Japan Utility Model Applications (OPI) Nos. 38982/88, 60880/89, 74076/89 and 87330/89 (the term "OPI" as used herein means an "unexamined published application"). In the stapler, staple sheets in the cartridge are sequentially fed out of it, starting with the lowermost of the staple sheets, by a feed belt provided under the cartridge, and the staple sheet housing body of the cartridge is vertically pushed toward the top of the feed belt to increase the frictional force between the lowermost staple sheet and the top of the feed belt to surely move the staple sheets one after another out of the housing body. For that reason, a force for fixing the housing body of the cartridge is made stronger than a force for fixing the front end part of the cartridge. As a result, the fixation of the front end part of the cartridge is likely to become unstable due to the vibration of the stapler in operation so that the vertical dimension of a staple sheet passage is changeable. Consequently, the foremost staple 340*a* of the staple sheet 340 is likely to turn by an angle of 90 degrees in such a direction that the load on the electric motor of the staple in bending the staple as U on an anvil 341 with a forming plate 342 by the power of the motor as shown in FIG. 17 is increased. This is a problem.

The present device of the fourth aspect of the present invention was made in order to solve the problem mentioned above. Accordingly, it is an object of the device to provide a mechanism for firmly fixing a cartridge to the cartridge fitting portion of an electric stapler so that the cartridge is not displaced relative to the portion due to the vibration of the stapler in operation.

The present device of a fifth aspect of the present invention relates to a staple sheet housing cartridge for an electric stapler of the type in which a staple sheet is bent to be formed as U and a staple is then driven out.

A conventional cartridge of such kind has a projection on the bottom of the front guide portion of the cartridge at the center of the bottom so that the projection pushes a staple sheet onto an endless belt which is a feed means, as disclosed in the Japanese Utility Model examined Publication No. 34855/88. The endless belt is tightly disposed to extend from the staple sheet housing body of the cartridge to the front end of the guide portion. Since the belt is pushed by the projection of the guide portion through the staple sheet, the distance between the belt and the sheet is decreased throughout a prescribed length to increase the frictional force between the sheet and the belt throughout the length so that deforming load does not concentrate on the sheet. For that reason, the staple of the sheet is not separated from the other staple thereof.

However, as for a cartridge having a feed roller means instead of such an endless belt and having a projection on the guide portion of the cartridge, a staple sheet receives load only at the place where the roller of the feed roller means is opposed to the projection. For that reason, the staple sheet is likely to be broken into parts. This is a problem.

The present device of the fifth aspect of the present invention was made in order to solve the problem mentioned above. Accordingly, it is an object of the device to provide a cartridge optimal for an electric stapler having a feed roller means.

The present device of a sixth aspect of the present invention relates to a staple sheet housing cartridge for an electric stapler of the type in which a staple sheet is partly bent as U and a staple is then driven out.

Generally, a cartridge of such kind housed staple sheets each consisting of staples conjoined together, so that the staple sheets are stacked together in the cartridge. The cartridge is fitted to the magazine of an electric stapler. The lowermost of the staple sheets is moved forward out of the housing body of the fitted cartridge through an outlet port provided at the bottom of the front wall of the housing body, and the staple is then bent as U and driven out. As described in a Japanese Utility Model Examined Publication No. 34854/88, a pusher is provided in the cartridge to push the entire housed staple sheets downward to make the feeding of the lowermost staple sheet good. Since the pusher has a pressure spring provided at the center of the cartridge, the entire staple sheets therein are pushed downward. For that reason, if the lowermost staple sheet is warped as a whole so as to have its central portion located below both the ends of the sheet, the front end of the sheet is likely to be caught at the outlet port so that the sheet is not smoothly moved out of the housing body through the outlet port. If a feed means provided at the magazine of the electric stapler to move the lowermost staple sheet forward out of the cartridge is made of a roller, the roller needs to be disposed near the front of the bottom of the cartridge because the area of the contact of the roller and the sheet is very small. The position of the pusher needs to correspond to that of the roller.

The present device of the sixth aspect of the present invention was made in order to solve the problem mentioned above. Accordingly, it is an object of the present device to provide a cartridge which is optimal for an electric stapler having a feed means made of rollers and makes it possible to securely and smoothly move a staple sheet out of the cartridge.

SUMMARY OF THE INVENTION

The electric stapler provided in accordance with the first aspect of the present invention is of the type in which a magazine is unmovably fixed. The stapler is characterized in that the magazine is secured to a body frame; a driver for driving-out the staple is supported by the magazine so that the driver can be rectilinearly reciprocated; a clincher, which receives the staple driven out by the driver, is supported by the body frame so that the clincher is located to face the driver and can be reciprocated on the production of the direction of the reciprocation of the driver; the driver is coupled to drive links at one end of each thereof; the links are supported by the body frame so that the links are swingable; the clincher is coupled to a clincher lever at one end thereof; the lever is supported by the body frame so that the lever is swingable; the links and the lever are associated at the other ends thereof with a drive control cam, which is rotated by an electric motor; and the driver and the clincher are nearly simultaneously moved toward and away from each other in mutually opposite directions through the rotation of the cam.

When the driver of the electric staple provided in accordance with the present invention is moved down through the rotation of the driven control cam to drive out the foremost staple downward along guide openings, the clincher is moved up nearly simultaneously with the downward movement of the driver to approach it. For that reason, the points of the legs of the driven-out staple are quickly put into contact with the surface of a stapled material set on the clincher and are therefore supported on the material, before the legs penetrate the material and collide against the clincher so that the legs are bent. The material is thus stapled Since the driven-out staple is thus quickly put into contact with the surface of the material and supported thereon, the staple does not buckle and the material is therefore smoothly and properly stapled. Since the staple performs a type of staple driving operation in which the driver is rectilinearly moved relative to the magazine unmovably secured to the body frame, the stapler does not need a high power source. Since the magazine is always in a predetermined position, the driver can be always rectilinearly moved without being affected by the movement of the drive links and the thickness of the stapled material. For that reason, the center lines of the driver and the clincher are always coincident with each other to cause the staple to precisely collide against the clincher so that the legs of the staple are properly bent.

In the staple sheet feeder provided for the electric stapler in accordance with the second aspect of present invention, a cartridge in which staple sheets each consisting of straight staples conjoined together are housed in a stacked state is fitted to the magazine of the stapler, and the staple sheets are sequentially moved out of the cartridge along the staple sheet guide of the magazine, starting with the lowermost of the sheets in the cartridge. The feeder is characterized in that ratchets are provided at the magazine so as to be turned only in an identical direction by a drive mechanism which runs a staple driver; front feed rollers and rear feed rollers are provided at the front and rear portions of the staple sheet guide so as to be turned in the same direction as the ratchet through them; the bottom of the lowermost staple sheet is located in contact with the rear feed rollers; and driven feed rollers are provided to be located opposite the front feed rollers a cross the staple sheet on the guide.

When the ratchet of the staple sheets feeder provided in accordance with the present invention is turned by the drive mechanism which runs the staple driver, the front and the rear feed rollers are turned in the same direction so that the lowermost staple sheet in the cartridge is moved out of it due to the friction of the sheet on the rear feed rollers so that the sheet is fed forward while being supported by the staple sheet guide of the magazine. The staple sheet is then put in between the front feed roller and the driven feed roller so that the sheet is fed forward further by the front feed rollers.

Since the staple sheet is thus fed by the feed rollers in kinematic conjunction with the drive mechanism which runs the staple driver, the rollers are worn less than in a staple sheet feeder of the type in which a staple sheet is continuously fed. Besides, several staples can be easily fed by the feed rollers through one time of turning thereof.

Since the frictional force between the front feed roller and the staple sheet is increased by the driven feed roller so that the feeding power of the front feed roller is made high. For that reason, the staple sheet can be smoothly and securely fed through a simple construction without using an accurate processed component and performing the adjustment thereof in assembly.

The staple sheet detector provided in accordance with the third aspect of the present device is for the electric stapler having a housing portion to house the cartridge which contains the staple sheets stacked together and has an opening at the bottom of the cartridge so that the lowermost of the staple sheets contained in the cartridge housed in the housing portion is exposed at the opening. In the stapler, the lowermost staple sheet is moved out of the cartridge through the opening by a feeder so that the sheet is fed to the front of a magazine. The staple sheet detector is characterized in that a detection switch is provided at the magazine and located in a position corresponding to that of the opening; a switching lever is attached to the switch; the size of the lever and the position of the tip of the lever are such that the switch is turned neither on nor off in response to the length of the displacement of the tip, which is not more than about the thickness of the staple sheet; and the lever is located behind the feeder and can be displaced along the direction of the feed of the staple sheet.

When the staple sheets have been all moved out of the cartridge in the housing portion to the front of the magazine by the feeder in the electric stapler employing the staple sheet detector provided in accordance with the present device, the resistance of the staple sheet to the self-restoring movement of the switching lever vanishes so that the lever restores its original form due to the elasticity of the lever. For that reason, the staple sheet detector can find out that there is no staple sheet in the cartridge.

Every time the lowermost staple sheet is moved out of the cartridge, the resistance of the staple sheet to the self-restoring movement of the switching lever vanishes so that the lever is displaced until coming into contact with the bottom of the second lowermost staple sheet and restores the original form of the lever. However, since the size of the switching lever and the position of the tip of the lever are such that the detection switch is turned neither on nor off in response to the length of the displacement of the tip, which is not more than about the thickness of the staple sheet, the switch is prevented from operating wrongly.

When it is found out through the detection switch of the staple detector that there is not staple sheet in the cartridge in the housing portion, the electric stapler stops operating. However, since the switching lever is located behind the feeder, at least a prescribed number of staples can be fed from the lowermost staple sheet by the feeder after the detection. For example, if the electric stapler is installed for a copying machine, a number of staples, which corresponds to the total number of the paper bins of the machine, can be fed by the feeder even after the detection. Besides, since the position of the switching lever can be shifted backward and forward, the number of staples which can be fed by the feeder after the detection can be modulated.

In the device of the fourth aspect of the present invention, the cartridge including a housing body which has an opening at the bottom of the body and in which staple sheets each consisting of straight staples conjoined together are housed in a stacked state, an outlet port provided at the bottom of the front wall of the body so that the lowermost of the staple sheets is moved forward out of the body through the outlet port, and a guide portion projecting forward from the port so as to guide the moved-out staple sheet at the top thereof is fixed to the magazine of the electric stapler by the mechanism provided in accordance with the present device. The mechanism is characterized in that the magazine is provided with an engagement part with which the front part of the guide portion is engaged, and with an elastic means which is engaged with the top of the rear part of the cartridge so as to urge the cartridge obliquely downward and forward.

The mechanism provided in accordance with the present device acts so that the cartridge is engaged with the magazine at the bottom of the front part of the cartridge and the top of the rear part thereof and urged obliquely downward and forward by the elastic means. For that reason, the cartridge is firmly fixed at the front part thereof to the engagement part of the magazine by the mechanism so as not to play. At a result, the cartridge does not loosen at the staple forming and driving-out portion of the stapler while being fitted to the magazine. Since the cartridge is thus firmly fixed to the magazine by the mechanism so as not to be displaced relative to the magazine due to a mechanical vibration, the foremost staple of the move-out staple sheet is unlikely to tumble and can therefore be securely formed and driven out.

The cartridge provided for the electric stapler in accordance with the fifth aspect of the present device is characterized by including a housing body in which staple sheets each consisting of straight staples conjoined together are housed in a stacked state and which is open at the front of the bottom of the housing body; an outlet port provided at the bottom of the front portion of the housing body so that the lowermost of the staple sheets is moved forward out of the body through the outlet port; a guide portion projecting forward from the outlet port so as to guide the moved-out staple sheet at the top thereof; and recesses or opening provided in the bottom of the guide portion.

The feed rollers of the feed roller means of the electric stapler having the cartridge provided in accordance with the present device are disposed in front and rear positions under the recesses or openings of the guide portion and the opening of the bottom of the housing body so that the roller correspond to the recesses or openings of the guide portion and the opening of the bottom of the housing body. Through the turning of the feed rollers, the lowermost of the staple sheets in the cartridge is moved out of the housing body through the outlet port on the basis of the frictional forces between the staple sheet and the rear feed rollers, and then fed forward out of the cartridge on the basis of the frictional forces between the sheet and the front feed rollers disposed under the recesses or openings of the guide portion. Although the frictional forces act between the bottom of the staple sheet and the front feed rollers at the recesses or openings of the guide portion, a frictional resistance does not act to the sliding of the top of the staple sheet at the recesses or openings. For that reason, the feeding power of the front feed rollers for the staple sheet is not reduced by the frictional resistance on the top of the staple sheet. As a result, the staple sheet is securely fed.

Since a part of the roller contact portion of the staple sheet is supported in contact with the bottom of the guide portion, the sheet is hardly deformed although it comes into pressure contact with the front feed rollers. For that reason, the staple sheet is unlikely to be broken into parts due to the deformation while being fed.

The cartridge optimal for the electric stapler having the feed roller means can thus be provided in accordance with the present device.

The cartridge provided in accordance with the sixth aspect of the present device includes a housing body which has an opening at the bottom of the body and in which the staple sheets each consisting of straight staples conjoined together are housed in a stacked state; an outlet port provided at the bottom of the front wall of the housing body so that the lowermost of the staple sheets is moved forward out of the body through the outlet port; and a guide portion projecting forward from the outlet port so as to guide the moved-out staple sheet at the top thereof. The cartridge is characterized in that a lid is provided on the top of the housing body; a push member is provided in the body so that the staple sheets housed therein are pushed downward by the member; the push member includes a wall portion located in contact with the inner surface of the front wall of the housing body, and a floor portion located in contact with the top of the uppermost of the staple sheets; and a spring is provided between the lid and the floor portion so that the force of the spring acts to the floor portion near the front end thereof.

Since the lowermost of the staple sheets stacked together in the cartridge provided in accordance with the present device receives both the weight of the other staple sheets and the force of the spring pushing all the staple sheets, a high frictional force acts to the lowermost staple sheet and each rear feed roller. Besides, since the staple sheets are pushed downward, particularly at the front portions thereof, by the spring, the front potions are flattened even if each staple sheet has a warp. A force for feeding the lowermost staple sheet acts to only the mutual contact parts of the sheet and each roller of the feed means of the electric stapler. For that reason, at least one roller of the feed means needs to be located near the front of the bottom of the cartridge. The position of the roller located near the front of the bottom of the cartridge corresponds to that of the sheet pushing spring so that the lowermost staple sheet is securely and smoothly fed forward out of the cartridge through the outlet port by a strong feeding force on the flattened portion of the staple sheet as the roller is turned.

Since the wall portion of the push member acts to keep the floor portion thereof nearly horizontal, the staple sheets are also kept nearly horizontal. For that reason, even if the bottom of the front portion of the housing body of the cartridge is entirely open, the staple sheets in the housing body are prevented from dropping out through the bottom.

DETAILED DESCRIPTION OF THE PREFERRED EMBODIMENTS

An embodiment of the present device is hereafter described with reference to the drawings attached hereto.

Figure 1:
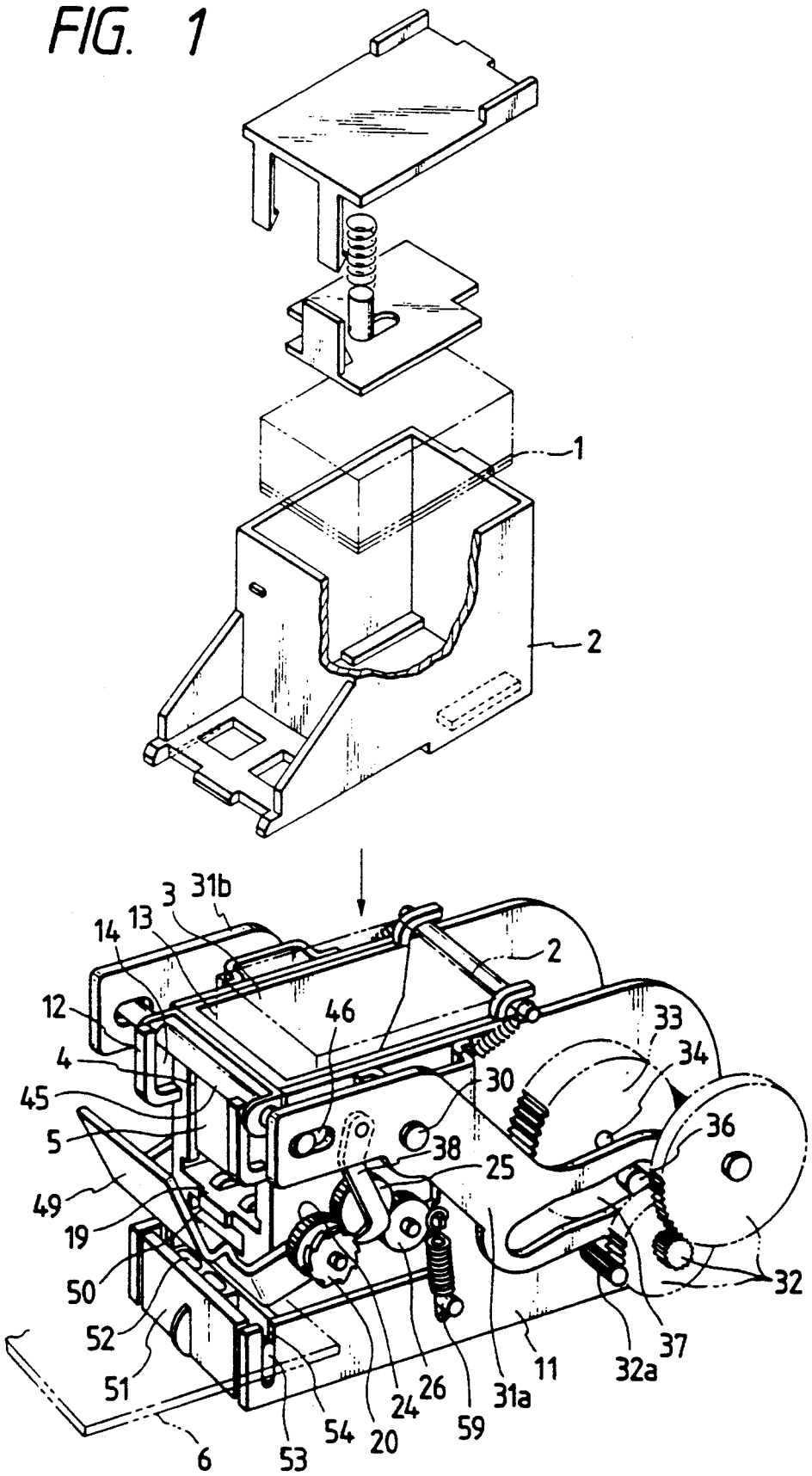
FIG. 1 is a perspective view of an electric stapler which is first embodiment of the present invention.

FIG. 1 shows an electric stapler which is the embodiment and functions so that a staple sheet consisting of straight staples conjoined together is formed as U at each staple and the staple is then driven out of the stapler. The stapler includes a magazine 3, a drive mechanism, and a clincher 51. The magazine 3 is provided with a feeder by which the staple sheets 1 stacked together in a cartridge 2 are sequentially fed out of it to a staple drive-out portion provided at the front end of the magazine. A forming plate 4, by which the staple fed to the drive-out portion is formed as U, and a staple driver 5 for driving out the staple formed as U are run by the drive mechanism. The clincher 51 supports a stapled material 6 at the bottom thereof, and acts to bend the legs of the staple driven out into the material by the driver so that the legs penetrate the material.

Figure 3:
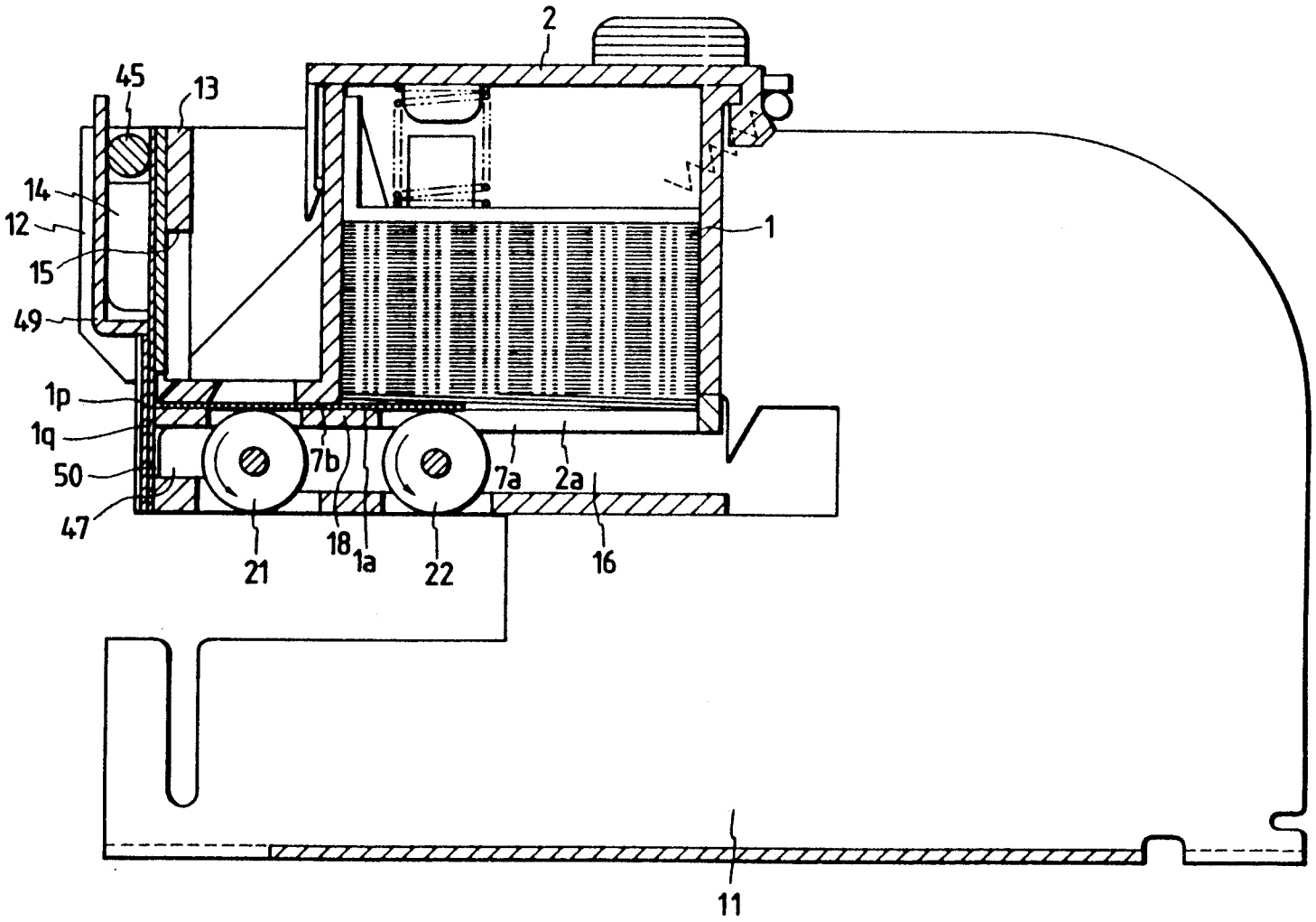
FIG. 3 is a partially and longitudinally sectional view of the stapler.

The cartridge 2, in which the staple sheets 1 are housed in a stacked state, is shaped as a box. As shown in FIG. 3, the cartridge 2 has an opening 7*a* at the bottom of the cartridge, and the lowermost 1*a* of the staple sheets in the cartridge is supported on projections 2*a* provided on both the side portions of the cartridge. The opening 7*a* communicates with an outlet opening 7*b* provided under the front portion of the cartridge 2 so that the lowermost staple sheet 1*a* is moved out of the cartridge through the outlet opening.

Figure 2:
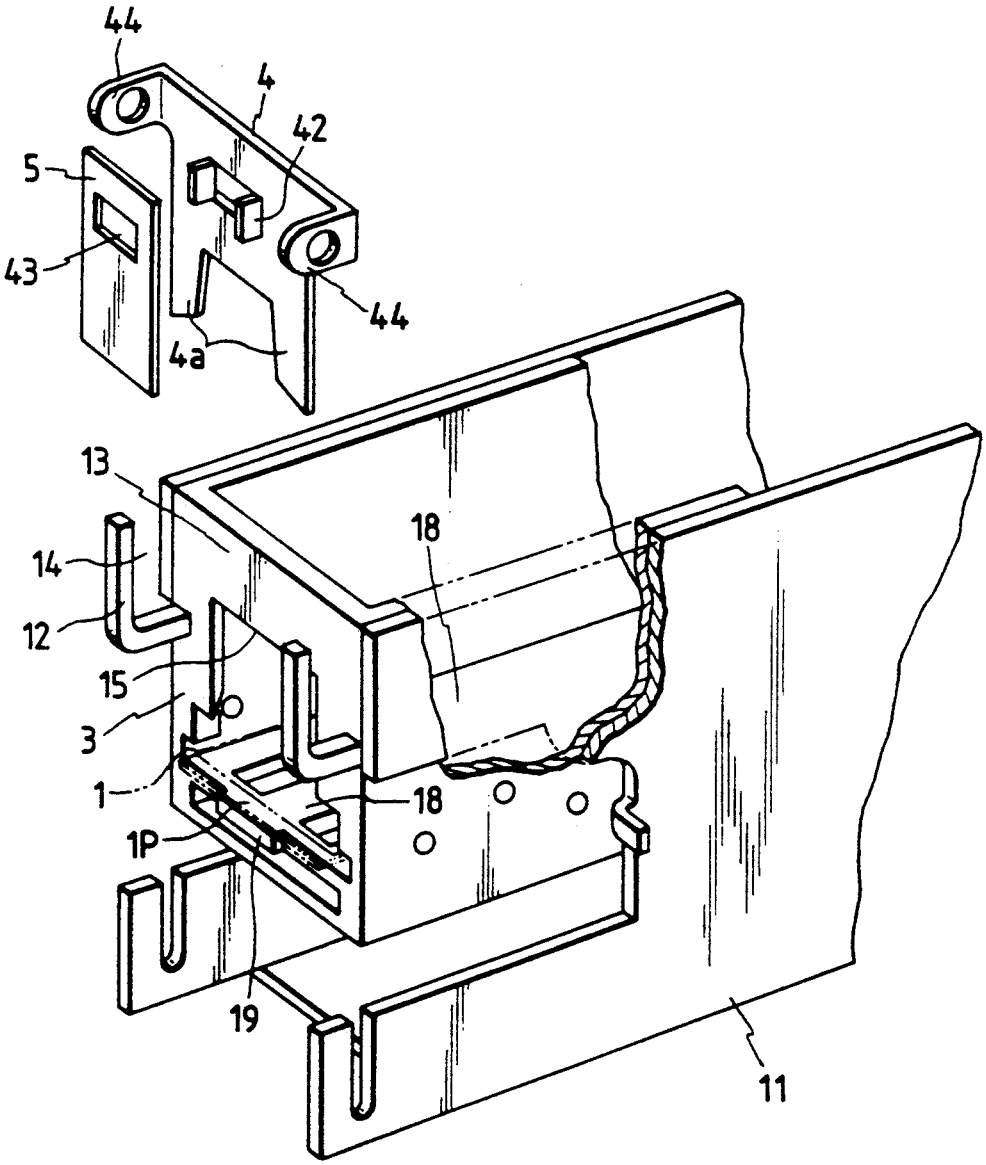
FIG. 2 is an exploded perspective view of the magazine of the stapler and the vicinity of the magazine.

As shown in FIG. 2, the magazine 3 is secured to the inside of the upper portion of a body frame 11 which looks shaped at U when vertically seen downward. L-shaped support members 12 are provided on the front 13 of the magazine 3. Guide openings 14 are defined between the front 13 of the magazine 3 and the support members 12.

Figure 4:
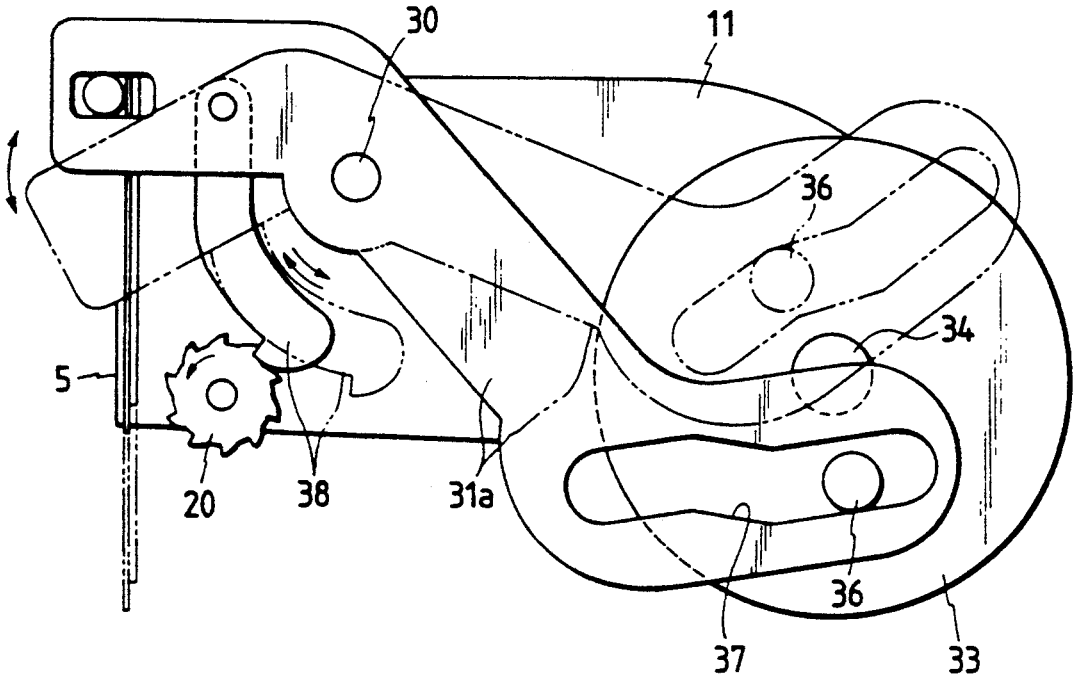
FIG. 4 is a view of the staple feeder of the stapler to illustrate how the ratchet of the feeder is turned.
Figure 5:
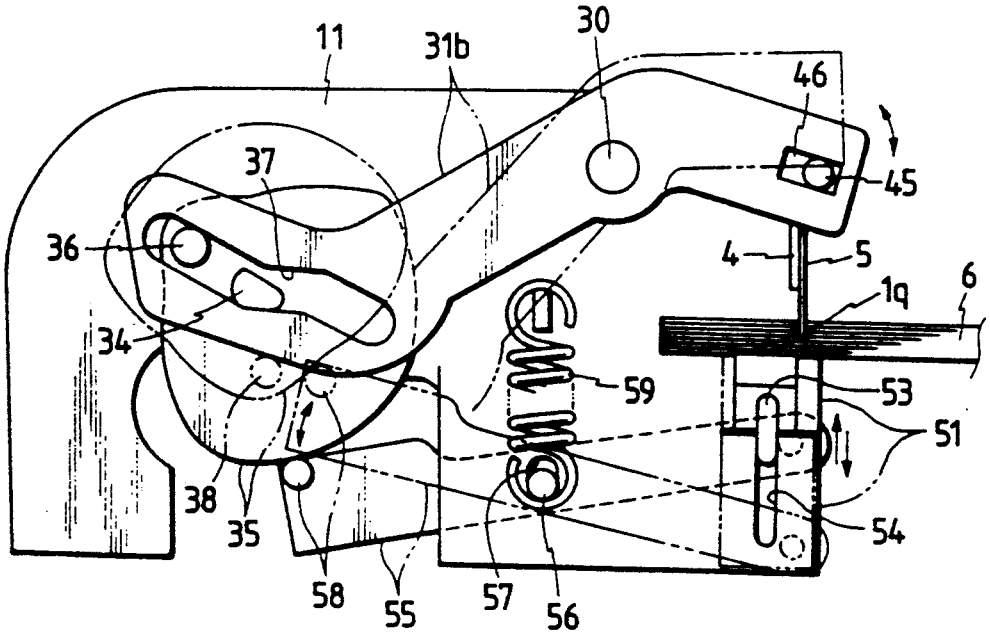
FIG. 5 is a view of the stapler to illustrate how the clincher and clincher lever thereof are run.

The stapler also includes a feeder by which the lowermost 1*a* of the staple sheets 1 stacked together in the cartridge 2 fitted to the housing part 16 of the magazine 3 is moved out of the cartridge so that the lowermost staple sheet is fed to the staple drive-out portion located at the front end of the magazine. The feeder includes ratchet 20, which are turned only in an identical direction by the drive mechanism which runs the staple driver 5, front feed rollers 21 provided on the same shaft as the ratchets and located lower than the staple sheets 1, rear feed rollers 22 provided to be in contact with the bottom of the lowermost staple sheet 1*a* in the cartridge 2 and turned in the same direction as the front feed rollers in kinematic conjunction therewith, and driven feed rollers 23 provided to be located opposite the front feed rollers across the staple sheet. As shown in FIG. 1, first gear 24 is provided on the same shaft as the ratchet 20 and the front feed rollers 21 and engages with intermediate gear 25 engaged with second gear 26 provided on the same shaft as the rear feed rollers 22. When an electric motor is put in action, the torque of gear 32*a* on the output shaft of the motor is transmitted to drive gear 33 and drive control cam 35 provided on the same shaft as the drive gear, as shown in FIGS. 1, 4 and 5. The gear 32*a* is engaged with speed reduction gears 32 engaged with the drive gear 33. When the drive gear 33 and the drive control cam 35 are rotated by the motor, eccentric pins 36 provided on the cam and the drive gear respectively are revolved in the cam holes 37 of the rear portions of the drive links 31*a* and 31*b* of the drive mechanism while sliding along the peripheries of the cam holes, so that the links are swung up and down about support shafts 30, and engagement claw 38 is moved up and down. The claw 38 is engaged with the ratchet 20 at the end of the downward movement of the claw, and turn the ratchet in the same direction by a prescribed angle at the upward movement of the claw. Along with the turning of the ratchet 20, the front feed rollers 21 are not only turned but also the rear feed rollers 22 are turned in the same direction as the front feed rollers through the transmission of the torque by the first gear 24, the intermediate gear 25 and the second gear 26. As a result, the lowermost staple sheet 1*a* is moved out of the cartridge 2 due to the friction contact of the sheet with the rear feed rollers 22 so that the sheet is fed forward while being supported by the staple sheet guide 18 of the magazine 3. The staple sheet 1*a* is then fed forward further to a staple forming and drive-out mechanism by the front feed rollers.

The staple forming and drive-out mechanism is provided in front of the magazine 3. The mechanism includes the staple forming plate 4 and the staple driver 5 which are disposed on each other at the front 13 of the magazine 3. The plate 4 and the driver 5 are moved up and down by the drive mechanism so that the staple sheet fed to the forming portion of the staple forming and drive-out mechanism by the feeder is formed as U at each staple, and the staple is then driven out toward the clincher 51 by the driver. As shown in FIG. 2, the central support juts 42 of the forming plate 4 extend through the hole 43 of the driver 5 and support it. Both the lateral lugs 44 of the forming plate 4 are penetrated by a support bar 45 slidably fitted in the guide openings 14 on the front of the magazine 3 and extending through the slender holes 46 of the drive links 31*a* and 31*b* at both the ends of the support bar.

Along with the upward and downward swing of the drive links 31*a* and 31*b*, the forming plate 4 and the driver 5 are simultaneously moved up and down. At the downward movement of the forming plate 4, it bestrides the forming part of the magazine 3, which is a projection 19 provided on the front end of the staple sheet guide 18 at the center of the front end. Since both the side edge parts of the front portion of the staple sheet 1*p* fed to the projection 19 by the feeder overhang both the end portions of the projection as shown in FIG. 2, both the lateral juts 4*a* of the forming plate 4 press the side edge parts of the front portion of the staple sheet at the downward movement of the forming plate so that the side edge parts are bent. The foremost staple 1*q* of the staple sheet is thus formed as U. The staple is then sent into the driver guide opening 50 of the drove-out portion of a face plate 49 by a pusher 47.

The staple driver 5 is moved down into the driver guide opening 50 so that the staple 1*q* sent into the opening is driven out toward the clincher 51, as shown in FIG. 5. The front portions of the drive links 31*a* and 31*b* are moved along arcs, while the forming plate 4 and the driver 5 are rectilinarly moved up and down in the guide openings 14 on the front of the magazine 3. Since the support bar 45 is slid in the slender holes 46 of the drive links 31*a* and 31*b*, the driver 5 is rectilinearly moved up and down.

Figure 6:
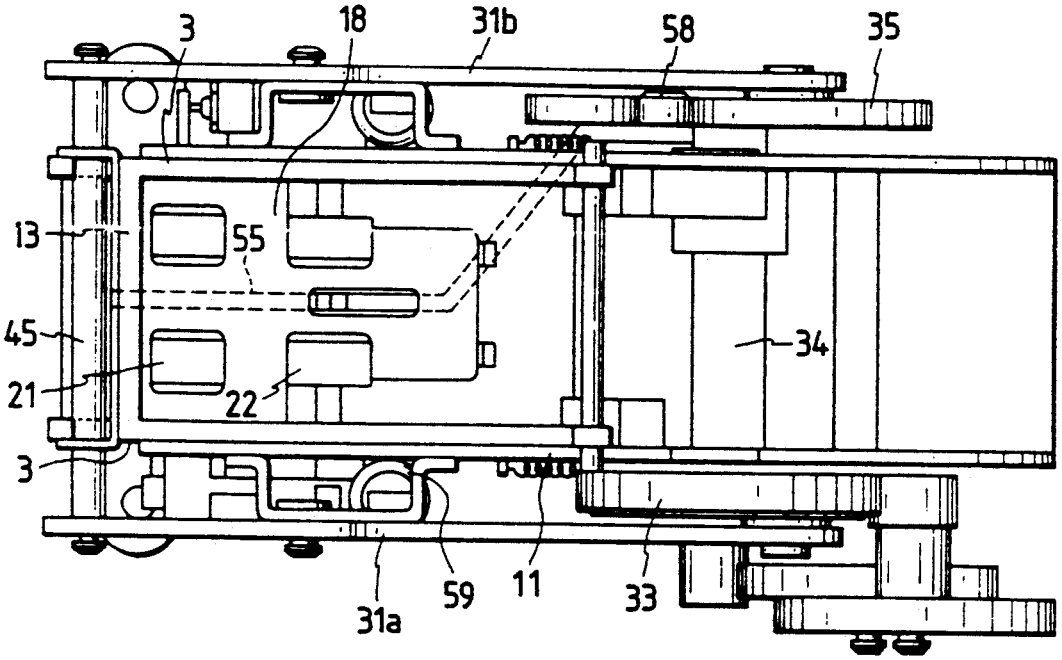
FIG. 6 is a plan view of a major part of the stapler.

The clincher 51 is provided at the lower portion of the front of the body frame 11, and faces the drive-out end of the staple driver 5. The clincher 51 is moved up and down in kinematic conjunction with the operation of the drive links 31*a* and 31*b*. The clincher 51 has clinching grooves 52 in the top of the central portion of the clincher, and juts 53 at both the ends of the clincher. The juts 53 are located in the guide openings 54 of the lower parts of the front portion of the body frame 11 so that the juts can be moved up and down. As a result, the clincher 51 is enabled to rectilinearly moved in the guide openings 54 along the production of the direction of the movement of the staple driver 5. As shown in FIGS. 5 and 6, the clincher 51 is pivotally coupled to the front end of a clincher lever 55 provided at the central portion of the body frame 11 and supported at the central portion of the clincher lever with a support shaft 56 provided on the lateral parts of the lower portion of the body frame and rotatably engaged in slender holes 57 slenderly extending vertically in the lateral parts to support the shaft. The clincher lever 55 has a projection 58 on the side surface of the lever at the rear end thereof, and is urged at the projection by a spring not shown in the drawings, so that the projection is in contact with the peripheral surface of the drive control cam 35. The support shaft 56 is urged upward by a tension spring 59.

Since the drive control cam 35 is sectorially shaped, the clincher lever 55 is swung up and down about the support shaft 56 depending on the form of the peripheral surface of the cam so that the clincher 51 is moved up and down in the guide openings 54. Since the staple driver 5 is moved through the rotation of the cam 35, the clincher 51 is moved up nearly at the same time as the downward movement of the driver 5 and moved down at the time of the upward movement of the driver.

Because of such constitution and operation, when the staple driver 5 is moved down along the guide opening 14 by the drive mechanism so that the staple 1*q* formed as U and sent into the drive-out portion of the face plate 49 at the front end of the magazine 3 is driven out of the portion by the driver, the clincher 51 is moved up by the drive mechanism to approach the driver, as shown in FIG. 5. For that reason, the tips of the legs of the staple 1*q* driven out by the driver 5 are quickly put into contact with the surface of the stapled material 6 set on the clincher 51 and are therefore supported on the material, before the tips penetrate the material and collide against the clincher so that the legs are bent. The material 6 is thus stapled.

Since the staple driver 5 and the clincher 51 approach each other in driving out the staple 1*q*, the driven-out staple is quickly put into contact with the surface of the material 6 and supported thereon. For that reason, the material 6 is smoothly and properly stapled. As for a conventional electric stapler of the type in which a clincher is unmovably fixed, the legs of a staple driven out by the stapler are not supported on a stapled material for a relatively long time from the driving-out of the staple to the contact of the legs with the material. For that reason, the direction of the movement of each leg of the staple driven out by the conventional stapler is likely to change so that the leg is oriented in an undesirable direction on the stapled material and buckle thereon. Particularly if the distance between the staple drive-out portion and clincher of the conventional stapler is relatively large, the leg of the staple is more likely to buckle.

Since, the drive mechanism performs such a type of operation that the staple driver 5 is rectilinearly moved relative to the magazine 3 unmovably fixed to the body frame 11, the mechanism does not need a high power source. Since the magazine 3 is always in a predetermined position, the driver 5 can be always rectilinearly moved without being affected by the movement of the drive links 31*a* and 31*b* and the thickness of the stapled material 6. For that reason, the center line of the driver 5 and that of the clincher 51 can be always kept coincident with each other to cause the staple to precisely collide against the clincher to properly bend the legs of the stable.

The support shaft 56 for the clincher lever 55 is fitted in the slender holes 57 so that the position of the shaft can be shifted in the holes against the force of the tension spring 59, depending on the thickness of the stapled material 6. The position of the support shaft 56 can thus be adjusted to the thickness of the material 6.

Since the drive mechanism performs the type of operation in which the staple driver 5 is rectilinearly moved although the magazine is unmovably fixed, the power source of the mechanism does not need to be as large as that of a drive mechanism which performs such a type of operation that a magazine and a staple driver are swung together. Since the magazine 3 is always in the predetermined position, the driver 5 can be always rectilinearly moved without being affected by the movement of the drive links 31*a* and 31*b* and the thickness of the stapled material 6.

As for the drive mechanism which performs the type of operation in which the magazine and the staple driver are swung together, the direction of the driver changes along with the swing of the magazine so that the angle of a staple to a stapled material at the time of the driving of the staple into it varies depending on the thickness of the material, namely, the center line of the driver and that of a clincher are made uncoincident with each other to render it likely that the staple does not precisely collide against the clincher and is improperly bent at the legs of the staple.

SECOND EMBODIMENT

A second embodiment of the present invention is hereafter described with reference to the drawings attached hereto.

Figure 7:
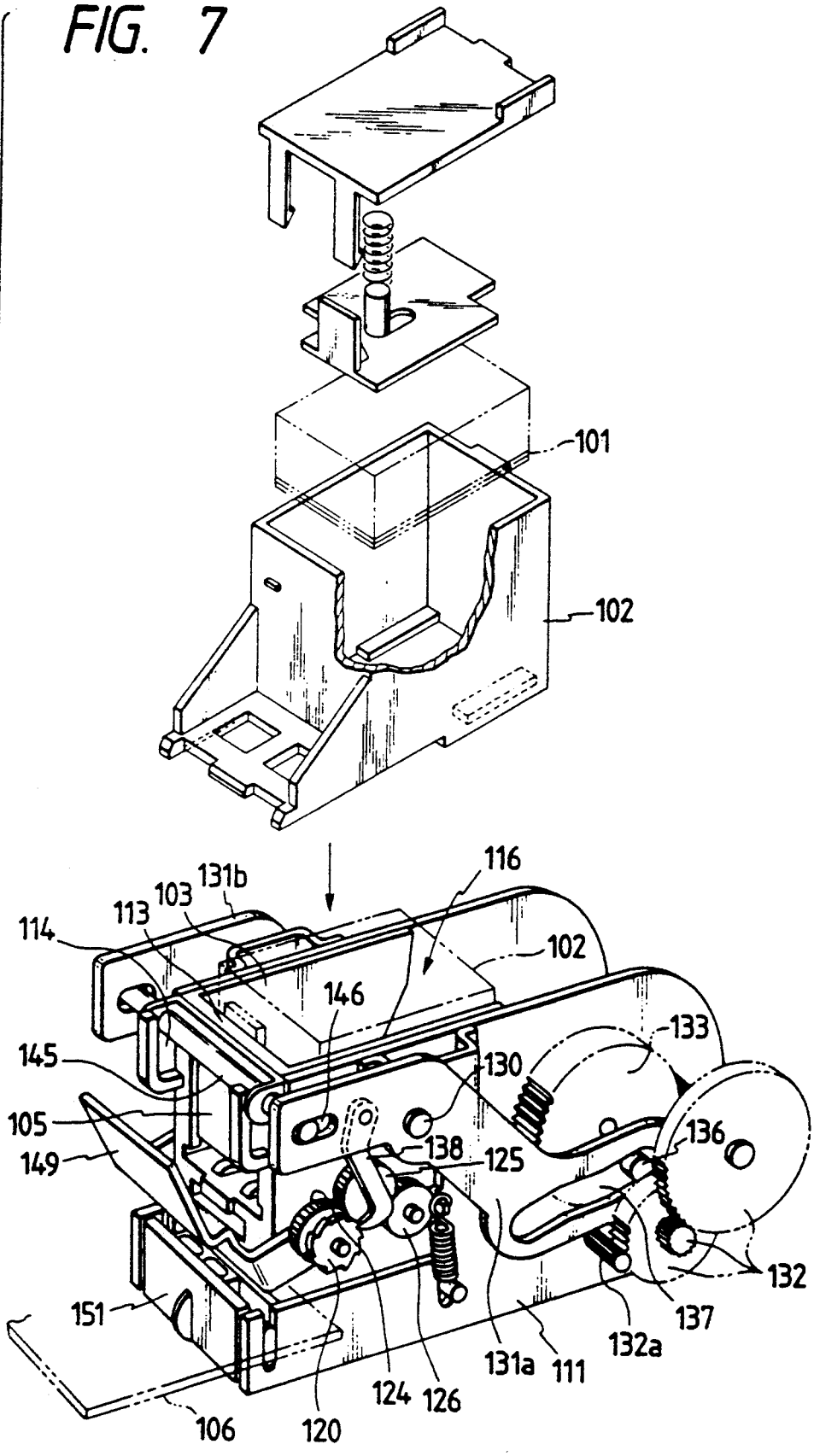
FIG. 7 is a perspective view of an electric stapler having a staple sheet feeder which is a second embodiment of the present invention.

FIG. 7 is an electric stapler having a staple sheet feeder which is the embodiment. The stapler functions so that a staple sheet consisting of straight staples conjoined together is formed as U at each staple and the staple is then driven out of the stapler. The feeder functions so that the staple sheets 101 stacked together in a cartridge 102 are sequentially fed out of it to the staple drive-out portion of the stapler, which is located at the front end of a magazine 103. The front end of the magazine 103 is covered with a face plate 149 having the staple drive-out portion at the rear thereof. FIG. 7 shows the stapler in the state that the face plate 149 is opened to make the front of the magazine 103 visible.

Figure 8:
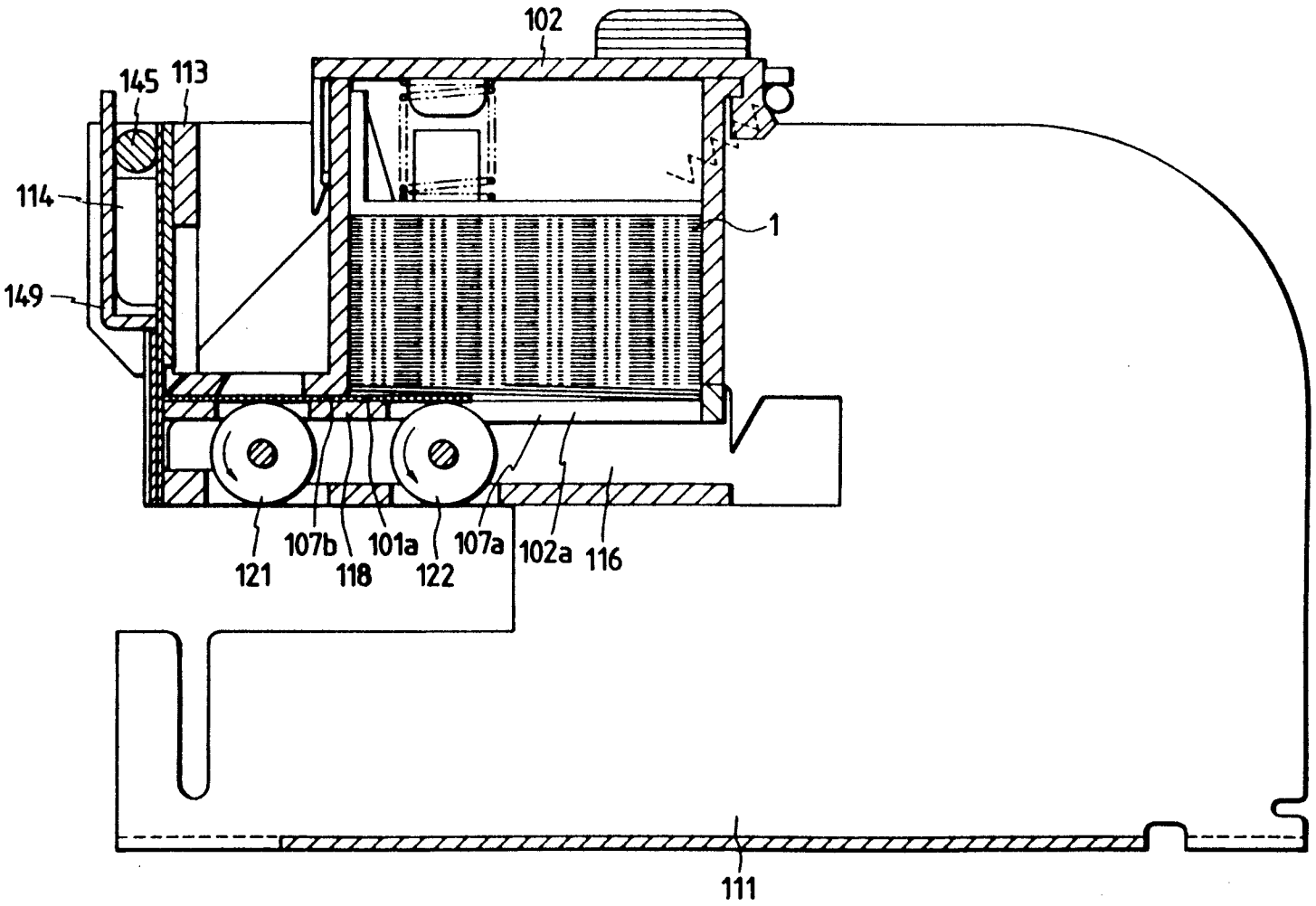
FIG. 8 is a partially and longitudinally sectional view of the stapler along the center line thereof.

The staple sheets 101 are housed in the cartridge 102 shaped as a box. As shown in FIG. 8, the cartridge 102 has an opening 107*a* at the bottom of the cartridge. The opening 107*a* communicates with an outlet port 107*b* provided at the bottom of the front portion of the cartridge 102 so that the lowermost staple sheet 101*a* is moved out of the cartridge through the outlet port. The lowermost staple sheet 101*a* is supported on projections 102*a* formed on both the side portions of the cartridge 102. The cartridge 102 is replaceably fitted in a prescribed position to the magazine 103. The magazine 103 is secured to the upper portion of a body frame 111 which looks shaped as U when vertically seen downward.

As shown in FIGS. 7, 8, 9 and 10, the staple sheet feeder includes ratchet 120 which is turned only in an identical direction by a drive mechanism, front feed rollers 121 provided on the same shaft as the ratchet and located under the staple sheets 101 housed in the cartridge 102, and rear feed rollers 122 provided to be in contact with the bottom of the lowermost staple sheet 101*a* in the cartridge and be turned in the same direction in kinematic conjunction with the front feed rollers. The ratchet 120 is located outside the body frame 111. The front and the rear feed rollers 121 and 122 are disposed in the magazine 103 so that the tops of the rollers are located slightly above that of a staple sheet guide 118, and the rear feed rollers are located under the cartridge housing portion 116 of the magazine and in contact with the bottom of the lowermost staple sheet 101*a* in the cartridge 102 fitted to the housing portion. As shown in FIG. 7, first gear 124 are provided on the same shaft as the front feed rollers 121 and the ratchet 120, and engaged with intermediate gear 125 engaged with second gear 126 provided on the same shaft as the rear feed rollers 122.

When the cartridge 102 is fitted in the cartridge housing potion 116 of the magazine 103, the bottom of the lowermost staple sheet 101*a* in the cartridge is put in pressure contact with the tops of the rear feed rollers 122 at the opening 107*a* of the bottom of the cartridge. When the ratchet 120 are then turned, the front feed roller 121 is not only turned but also the rear feed rollers 122 are turned in the same direction as the front feed rollers through the transmission of torque by the first gear 124, the intermediate gear 125 and the second gear 126. As a result, the lowermost staple sheet 101*a* is moved out of the cartridge 102 due to the friction contact of the sheet with the rear feed rollers 122, and fed forward while being supported by the staple sheet guide 118 of the magazine 103, as shown in FIG. 8, so that the sheet in fed forward further by the front feed rollers. The staple sheet 101*a* is thus moved to the staple forming portion of the stapler through the opening of the front portion 113 of the magazine 103. The staple of the sheet 101*a* is then sent to the staple driven-out portion of the face plate 149. The staple forming portion is located at the front end of the staple sheet guide 118.

The driven mechanism, which turns the ratchet 120, includes a pair of links 131*a* and 131*b* supported with support shafts 130 provided on the outer surfaces of both the side portions of the body frame 111, gear 132*a* which is provided on the output shaft of an electric motor provided in the rear portion of the body frame and are engaged with speed reduction gears 132 provided at the side portion of the body frame and engaged with drive gear 133, eccentric pins 136 secured to the drive gear and a drive control cam which is pivotally provided at the other side portion of the body frame, and slidably fitted in the cam holes 137 of the rear portions of the drive links, engagement claw 138 supported with shaft on the front portion of the drive link, and spring which is not shown in the drawing but always urge the claw to engage it with the ratchet.

Figure 9:
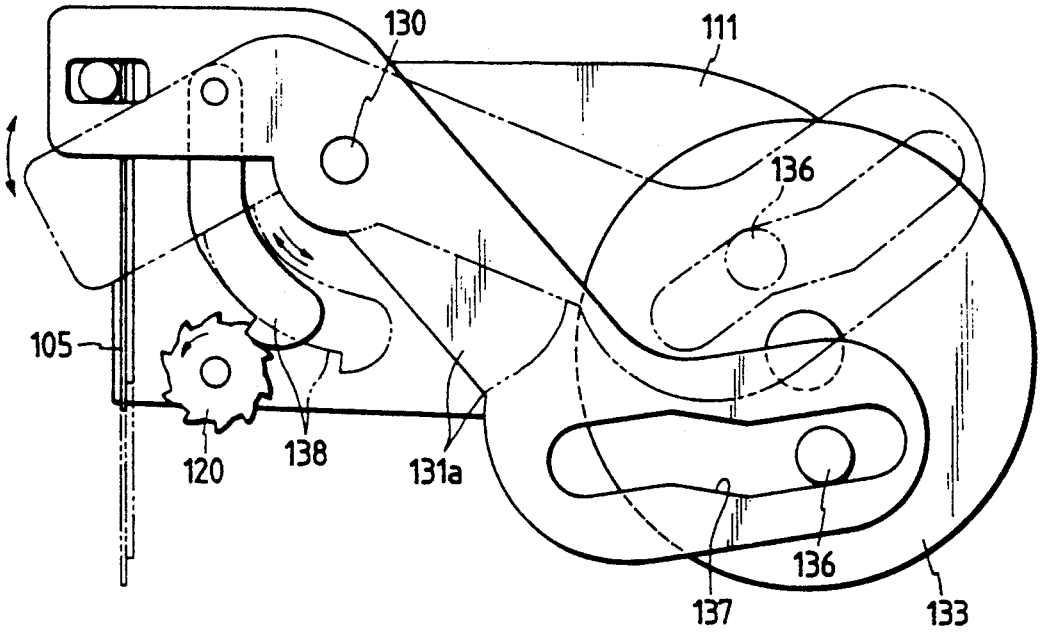
FIG. 9 is a view of the stapler to illustrate how a ratchet is turned.
Figure 10:
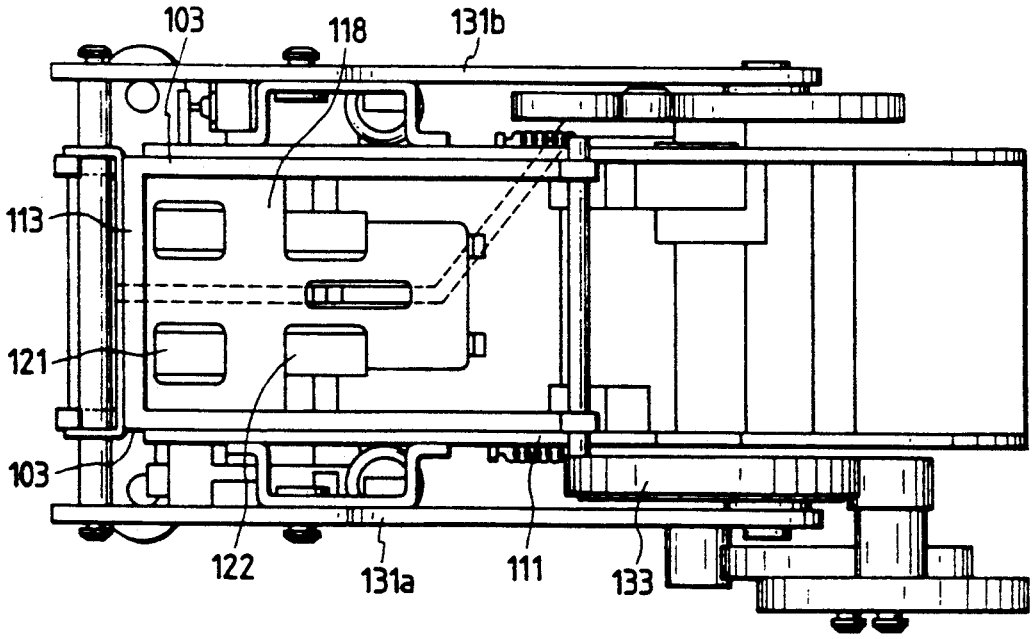
FIG. 10 is a plan view of a major part of the stapler.

When the electric motor is rotated, the torque of the output shaft thereof is transmitted to the drive gear 133 through the gear 132*a* and the speed reduction gears 132 so that the drive gear is turned. As a result, the eccentric pins 136 are slid in the cam holes 137 of the links 131*a* and 131*b* along the peripheries of the holes so that the drive links are swung up and down about the support shafts 130, and the engagement claw 138 are moved up and down, as shown in FIG. 9. The claw 138 are engaged with the ratchet 120 at the end of the downward movement of the claw and turns the ratchet by a prescribed angle at the upward movement of the claw so that the front and the rear feed rollers 121 and 122 are simultaneously turned in the same direction. Since the engagement claw 138 are not engaged with the ratchet 120 at the next downward movement of the claw, the ratchet 120 is turned in the same direction only at the upward movement of the claw. The number of the staples which are fed by the feeder through one time of turning of the ratchet 120 may be about six.

The drive mechanism may include vertically moving solenoid means instead of linkages described above.

After the staple sheet fed to the front end of the magazine 103 by the feeder is formed as U at the staple of the sheet by the staple forming portion, the staple is sent to the staple drive-out portion of the face plate 149 and then driven out into a stapled material 106 by a staple driver 105 which is run by the drive mechanism in conjunction with the turning of the ratchet 120. The staple driver 105 is provided at the front portion 113 of the magazine 103 and supported by a support bar 145 slidably fitted in the guide openings 114 of the front portion and extending through the slender holes 146 of the front portions of the drive links 131*a* and 131*b* at both the ends of the bar, so that along with the vertical swing of the drive links, the ratchet 120 is turned and the staple driver is moved up and down with the support bar along the front portion 113 of the magazine. At the downward movement of the staple driver 105, the staple sent to the drive-out portion of the face plate 149 is driven out into the stapled material 106 by the driver. At that time, the staple penetrates the material 106 and collides against a clincher 151 so that the staple is bent at the legs thereof. The material 106 is thus stapled.

Since the staple sheet 101 is fed by the feed rollers 121 and 122 through the operation of the driven mechanism in conjunction with the running of the staple driver 105 as mentioned above, the rollers are worn less than in a staple sheet feeder of the type in which a staple sheet is continuously fed. Besides, several staples can be easily fed by the feed rollers 121 and 122 through one time of turning thereof. For that reason, the staple sheet can be smoothly and securely fed through a simple construction without using an accurate processed component and performing the accurate adjustment thereof in assembly.

THIRD EMBODIMENT

A third embodiment of the present device is hereafter described with reference to the drawings attached hereto.

Figure 11:
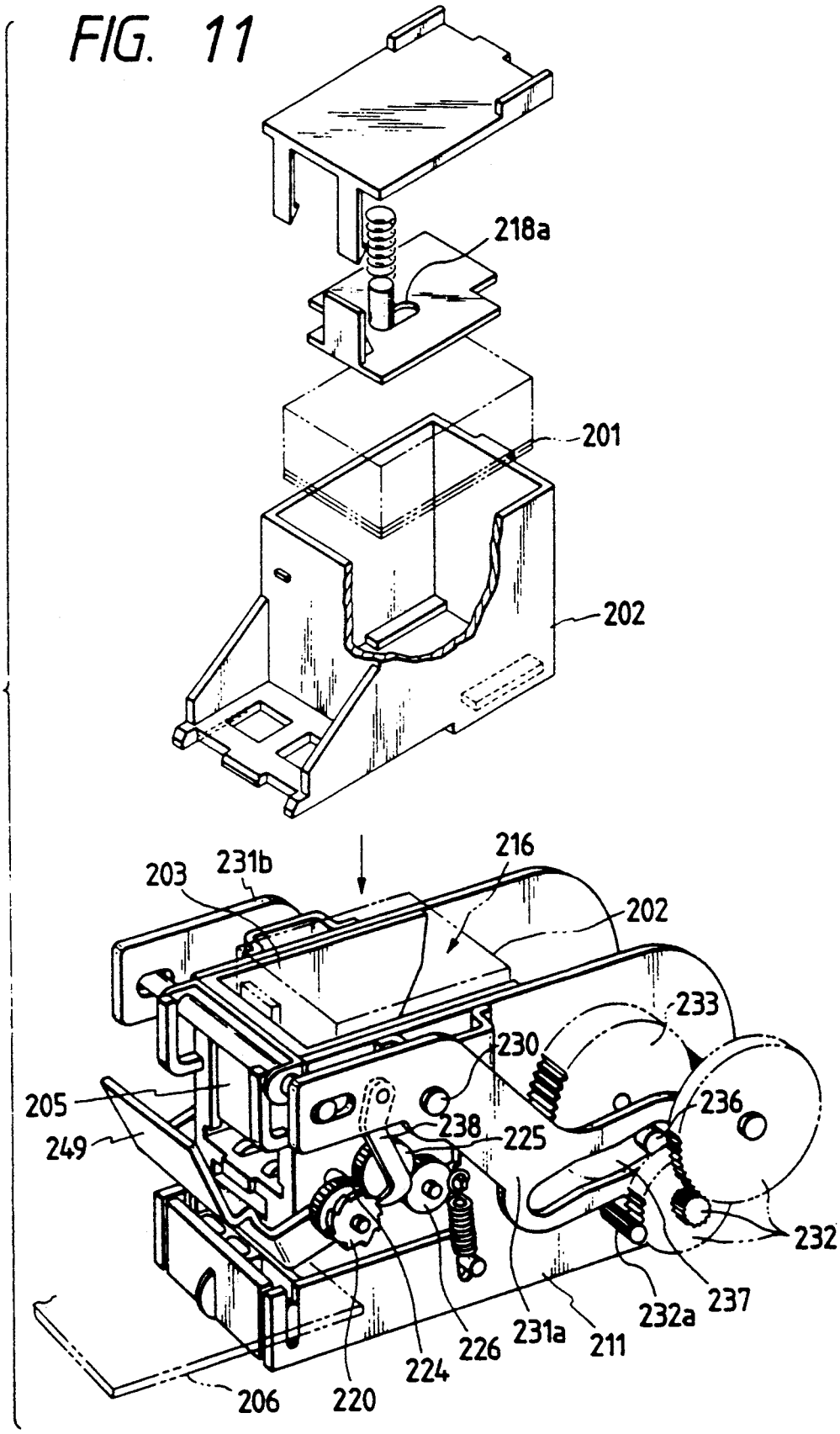
FIG. 11 is a perspective view of an electric stapler employing a staple sheet detector which is a third embodiment of the present device.
Figure 12:
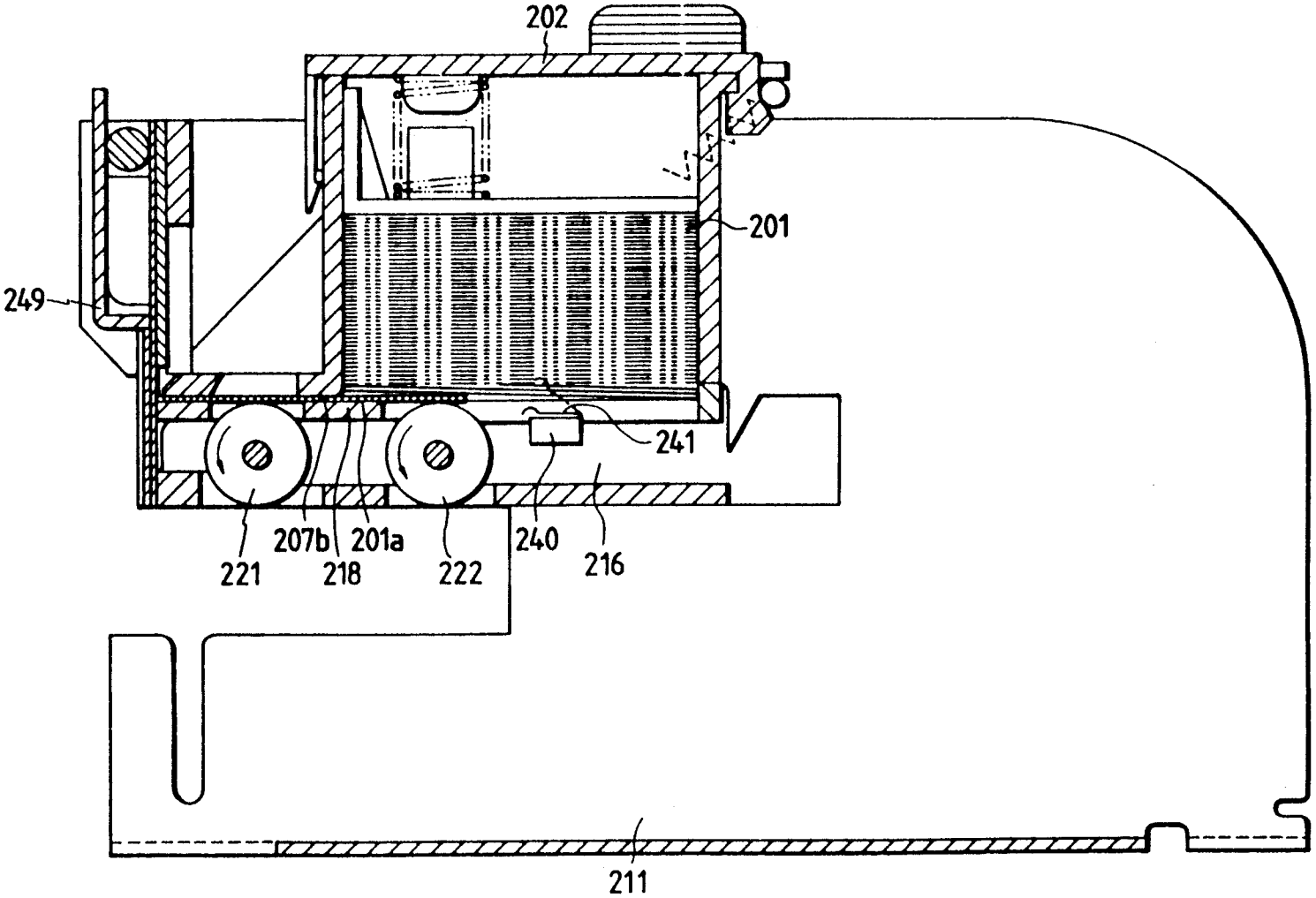
FIG. 12 is a partially and longitudinally sectional view of the stapler.
Figure 13:
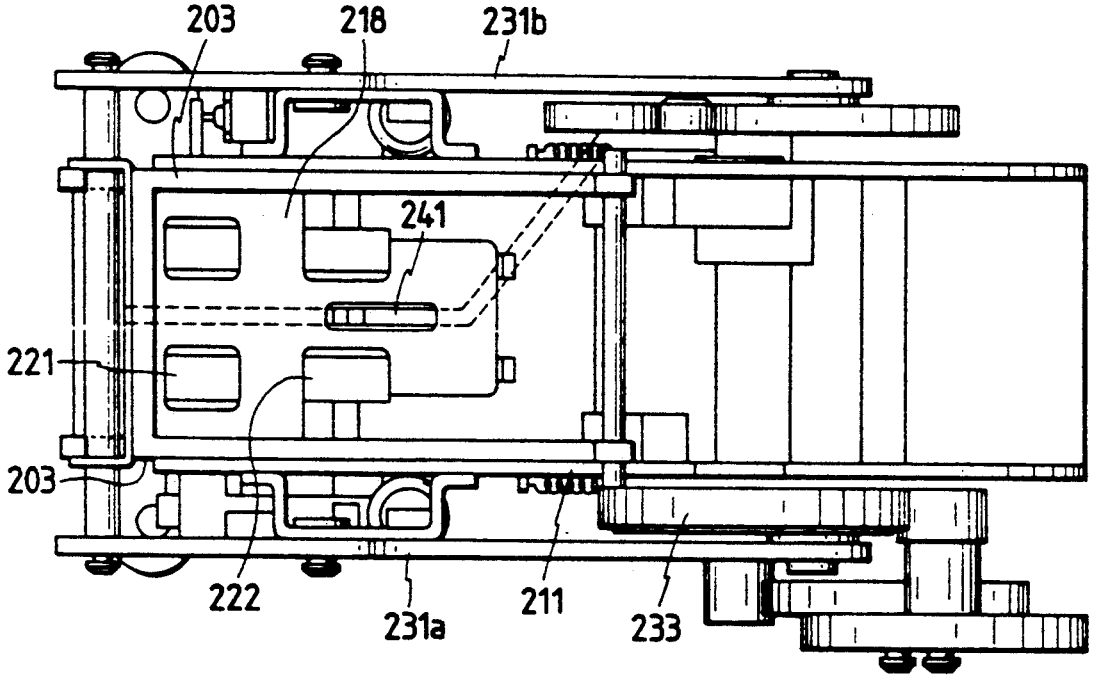
FIG. 13 is a plan view of a major part of the stapler.

FIG. 11 shows an electric stapler having a staple sheet detector which is the embodiment. The stapler functions so that each straight staple of a staple sheet 201 consisting of the straight staple conjoined together is formed as U and then driven out from the stapler. The stapler includes a staple feeder by which the staple sheets 201 stacked together in a cartridge 202 as shown in FIG. 12 are sequentially fed out of the cartridge to a drive-out portion at the front end of a magazine 203, which is covered with a face plate 249 having the drive-out portion at the rear of the plate. FIG. 11 shows the stapler in the state that the face plate 249 is opened to make the front end of the magazine 203 visible.

The cartridge 202, in which the staple sheets 201 are stacked together, is shaped as a box and has an opening 207*a* at the bottom of the cartridge. The lowermost staple sheet 201*a* is supported on projections 202*a* formed on both the side portions of the cartridge 202. The opening 207*a* communicates with an outlet port 207*b* provided at the bottom of the front portion of the cartridge 202 so that the lowermost staple sheet 201*a* is moved out of the cartridge through the outlet port. The cartridge 202 is replaceably fitted in the cartridge housing portion 216 of the magazine 203. The magazine 203 is secured to the upper portion of the body frame 211 of the stapler. The body frame 211 looks shaped as U when vertically seen downward.

The staple feeder includes ratchet 220 which are turned only in an identical direction by a drive mechanism, front feed rollers 221 provided on the same shaft as the ratchet and located under the staple sheets 201, and rear feed rollers 222 provided to be located in contact with the bottom of the lowermost staple sheet 201*a* in the cartridge 202 and be turned in the same direction in kinematic conjunction with the front feed rollers. The front and the rear feed rollers 221 and 222 are disposed in the magazine 203 so that the tops of the rollers are located slightly above that of a staple sheet guide 218, and the rear feed rollers are located under the cartridge housing portion 216 of the magazine 203 and in contact with the bottom of the lowermost staple sheet 201*a* in the cartridge 202 fitted in the housing portion. First gear 224 is provided on the same shaft as the front feed rollers 221 and the ratchet 220, and engaged with intermediate gear 225 engaged with second gear 226 provided on the same shaft as the rear feed rollers.

The drive mechanism for turning the ratchet 220 includes a pair of drive links 231*a* and 231*b* supported by support shafts 230 provided on the side portion of the body frame 211, an electric motor provided in the rear portion of the body frame, gear 232*a* secured to the output shaft of the motor and engaged with speed reduction gears 232 provided at the side of the body frame and engaged with drive gear 233, eccentric pins 236 secured to the drive gear and a drive control cam which is pivotally provided at the other side portion of the body frame, and slidably fitted in the cam holes 237 of the rear portions of the drive links, engagement claw 238 supported by the front portions of the drive link, and springs which are not shown in the drawings but always urge the claw to engage them with the ratchet.

When the electric motor is rotated, the torque of the output shaft thereof is transmitted to the drive gear 233 the drive gear are turned. As a result, the eccentric pins 236 are slid in the cam holes of the rear portions of the drive links 231*a* and 231*b* along the peripheries of the cam holes so that the links are swung up and down about the support shafts 230, and the engagement claw 238 are moved up and down. The claw 238 are engaged with the ratchet 220 at the end of the downward movement of the claw and turn the ratchet by a prescribed angle at the upward movement of the claw so that the front and the rear feed rollers 221 and 222 are simultaneously turned in the same direction. At the next downward movement of the claw 238, they are not engaged with the ratchet 220. Therefore, the ratchets 220 are turned in the same direction only at the upward movement of the claw 238.

Since the tops of the rear feed rollers 222 are in pressure contact with the bottom of the lowermost staple sheet 201*a* at the opening of the bottom of the cartridge 202, the turning of the ratchet results in not only rotating the front feed rollers 221 in the same direction but also turning the rear feed rollers 222 in the same direction through the transmission of torque by the first, the intermediate and the second gears 224, 225 and 226. As a result, the lowermost staple sheet la is moved out of the cartridge 202 by the rear feed rollers 222 because of friction contact therewith so that the staple sheet is fed forward while being supported by the staple sheet guide 218 of the magazine 203. Consequently, the staple sheet 201*a* is fed forward further toward the drive-out portion of the face plate 249. After the foremost staple of the staple sheet 201*a* is formed as U by a forming mechanism not shown in the drawings, the staple is sent to the drive-out portion of the face plate 249 and then driven out into a stapled material 206 by a staple driver 205.

The staple sheet detector for determining whether the staple sheet is present in the cartridge 202 is provided under the cartridge housing portion 216 of the magazine 203. The detector has a microswitch 240 for making such determination. The microswtich 240 is located to face the opening 207*a* of the bottom of the cartridge 202 fitted in the housing portion 216, and is provided with an elastic switching lever 241 urged to extend into the cartridge 202 through the slender hole 218*a* of the staple sheet guide 218. When the staple sheet 201 is present in the Cartridge 202, the lever 241 is bent in contact with the bottom of the staple sheet so that the microswitch 240 is turned off. When the staple sheet 201 is not present in the cartridge 202, the lever 241 is not bent, so that the microswitch 240 is turned on. The size of the lever 241 and the position of the tip of the lever are such that the microswitch 240 is turned neither on nor off in response to the displacement of the tip of the lever if the length of the displacement is not more than about the thickness of the staple sheet 201. The lever 241 is located behind the staple feeder. The position of the lever 241 can be shifted backward and forward. For that purpose, it or the like is enabled that a screw for securing the microswitch 240 is loosened and the microswitch is then slid along the slender hole 218*a* of the staple sheet guide 218.

When the staple sheet 201 is present in the cartridge 202, the switching lever 241 of the staple sheet detector is bent in contact with the bottom of the staple sheet so that the microswitch 240 is turned off, as mentioned above. In that case, the electric stapler can continuously perform stapling. When there is no staple sheet in the cartridge 202 because the last staple sheet is already fed out of the cartridge 202, the lever 241 is not bent, so that the microswitch 240 is turned on. In that case, a signal indicating that there is no staple sheet in the cartridge 202 is generated.

Every time the lowermost 201*a* of the staple sheets 201 in the cartridge 202 is fed out of it, the resistance of the staple sheet to the self-restoring movement of the switching lever 241 vanishes so that the lever is displaced at the tip thereof until coming into contact with the bottom of the second lowermost staple sheet, and restores the original form of the lever. However, since the size of the lever 241 and the position of the tip of the lever are such that the microswitch 240 is turned neither on nor off in response to the length of the displacement of the tip of the lever, which is not more than about the thickness of the staple sheet, the microswitch is prevented from operating incorrectly.

Since the switching lever is located behind the staple feeder, at least a prescribed number of staples can be fed to the staple driver 205 after it is determined through the microswitch 240 of the staple sheet detector that there is no staple sheet in the cartridge 202. For example, if the electric stapler is installed for a copying machine, a number of staples, which corresponds to the total number of the paper bins of the machine, can be fed to the staple driver by the staple feeder even after the determination. Besides, since the position of the switching lever 241 can be shifted backward and forward, the number of staples which can be fed to the staple driver 205 by the feeder after the determination can be modulated.

FOURTH EMBODIMENT

A fourth embodiment of the present device is hereafter described with reference to the drawings attached hereto.

Figure 14:
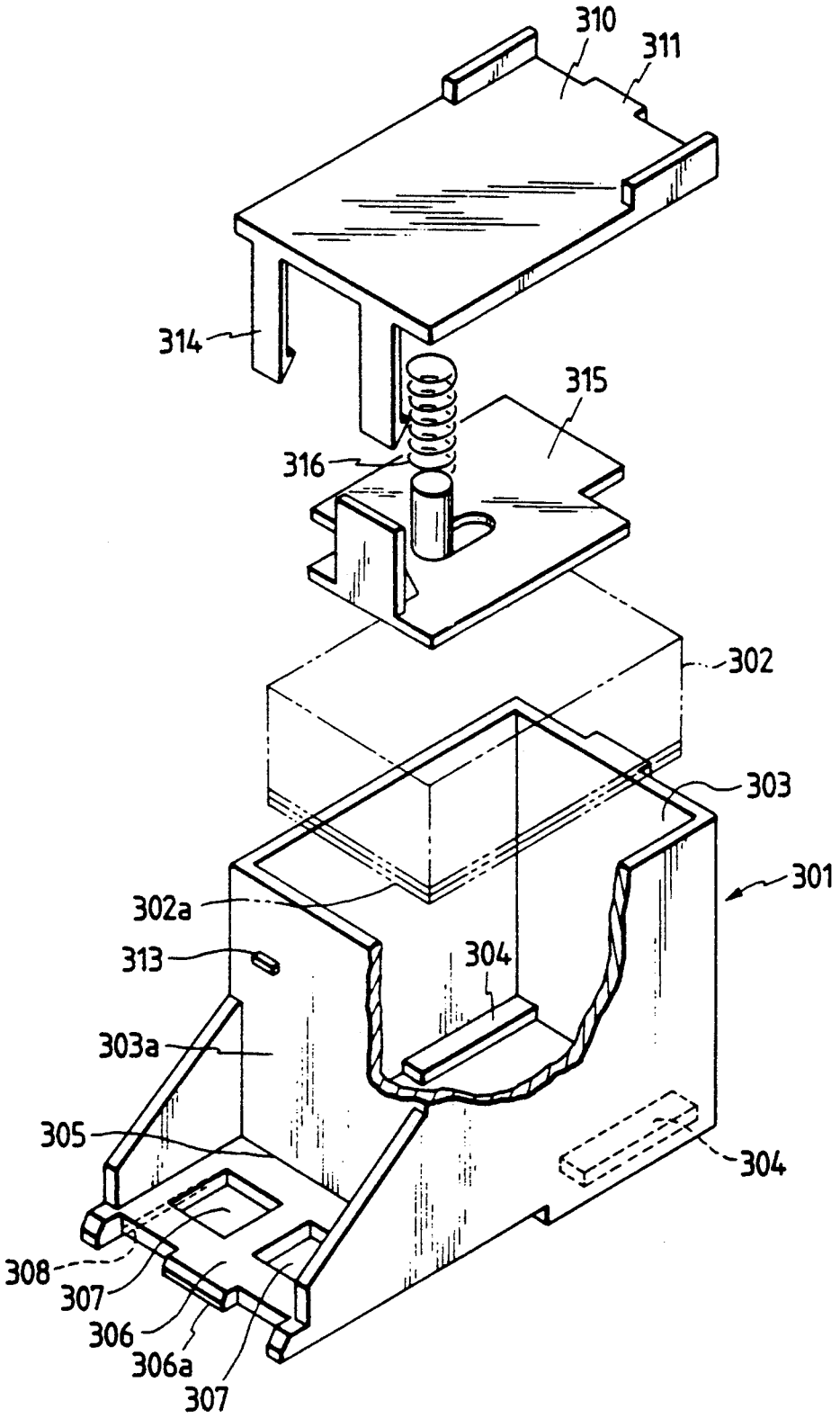
FIG. 14 is a perspective view of a cartridge provided with a fixation mechanism which is a fourth embodiment of the present device.

Shown at 301 in FIG. 14 is a cartridge which is for an electric stapler and is the embodiment. The cartridge 301 includes a housing body 303, support strips 304, an outlet port 305, and a guide portion 306. The housing body 303 is open at the bottom thereof. Staple sheets 302 each consisting of straight staples conjoined together are housed in a stacked state in the housing body 303. The support strips 304 are provided on the inner surfaces of both the side walls of the housing body 303 at the rear portions of the walls so as to support the lowermost staple sheet 302*a* at both the side edges thereof in the body. The outlet port 305 is provided at the bottom of the front wall 303*a* of the housing body 303 so that the lowermost staple sheet 302*a* is moved forward out of the body through the outlet port. The guide portion 306 projects forward from the outlet port 305 so as to guide the moved-out staple sheet 302*a* at the top thereof. The guide portion 306 has openings 307, hanging parts 308 at the bottoms of both the sides of the portion. The height of each of the hanging parts 308 is slightly larger than the thickness of the staple sheet 302. The hanging parts 308 extend continuously from the bottom of the opening of the housing body 303. The front end 306*a* of the guide portion 306 is chamfered at an acute angle.

The cartridge 301 also includes a lid 310, a push member 315, and a helical spring 316. The lid 310 has an engagement projection 311 at the rear end of the lid so that the projection is engaged with the bent top portion of the housing body 303. The rear of the projection 311 has an engagement part 312. The lid 310 has engagement hangers 314 extending down from the front end of the lid so that the hangers are engaged with projections 313 provided on the front wall 303*a* of the housing body 303. The helical spring 316 is provided between the lid 310 and the push member 315 near their front ends to always push down the staple sheets 302 set in the housing body 303.

Figure 15:
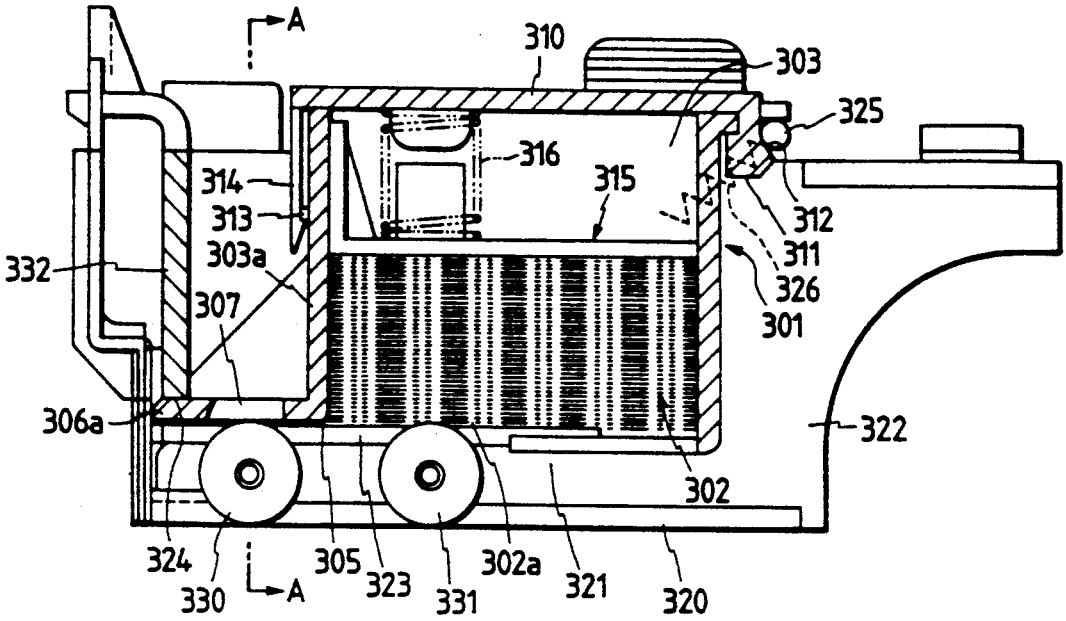
FIG. 15 is a sectional view of the cartridge fitted to the magazine of an electric stapler.
Figure 16:
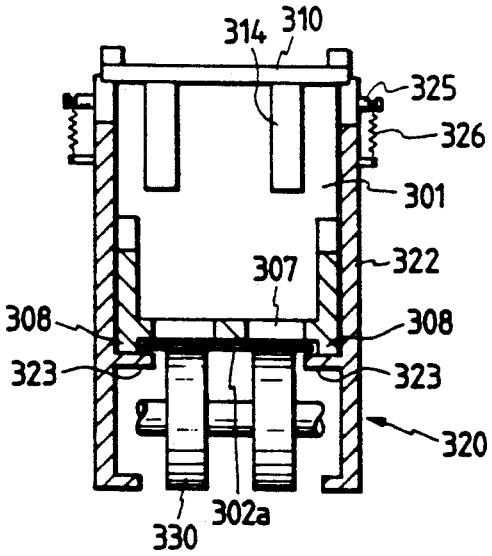
FIG. 16 is a sectional view of the cartridge along a line A—A shown in FIG. 2.
Figure 17:
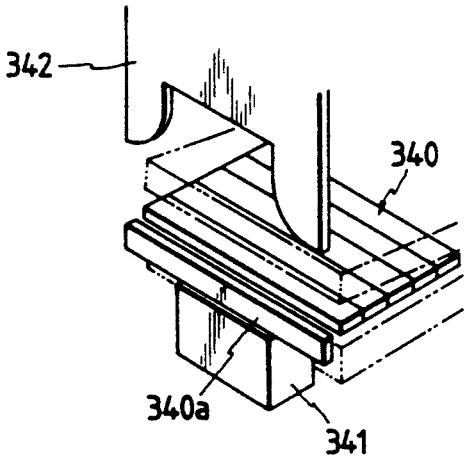
FIG. 17 is a view of illustrate how a staple is conventionally formed.

As shown in FIGS. 15 and 16, the cartridge 301 is removably attached to the magazine 320 of the electric stapler. The magazine 320 has a central fitting portion 321 to which the cartridge 301 housing the staple sheets 302 is fitted. The fitting portion 321 has support projections 323 extending inward from the lower portions of the side walls 322 of the magazine 320, an engagement opening 324 provided between the bottom of the front portion 332 of the magazine and the front ends of the support projections, and a hold-down bar 325 provided near the tops of the rear portions of the side walls of the magazine so that the bar can be slid on the tops of the side walls. The bar 325 is urged obliquely downward and forward by springs 326. An elastic means is thus composed of the hold-down bar 325 and the springs 326. The elastic means may be made of an integrated spring instead of the bar 325 and the springs 326.

To fit the cartridge 301 to the fitting portion 321 of the magazine 320, the front end 306*a* of the guide portion 306 of the cartridge 301 is engaged on the engagement opening 324 of the magazine and the cartridge is then strongly pushed downward at the rear portion thereof so that the hold-down bar 325 is moved back against the forces of the springs 326 and engaged on the engagement part 312 of the cartridge. At that time, the cartridge 301 is supported at the bottom thereof by the support projections 323 on the side walls 322 of the magazine 320. The cartridge 301 can be easily removed from the fitting portion 321 of the magazine 320 if the cartridge is pulled up so that the hold-down bar 325 is moved back against the forces of the springs 326.

Since the cartridge 301 is thus engaged with the magazine 320 at the bottom of the front part of the cartridge and the top of the rear part thereof and urged obliquely downward by the hold-down bar 325, the cartridge is firmly fixed at the front part thereof to the engagement part 324 of the magazine 320 so as not to play to loosen while being fitted to the fitting portion 321 of the magazine. The cartridge 301 can thus be firmly fixed to the fitting portion 321 of the magazine 320 so as not to be displaced relative to the portion by a mechanical vibration.

A feeder is provided at the lower portion of the magazine 320 so that the staple sheets 302 in the cartridge 301 are sequentially fed forward out of it by the feeder, starting with the lowermost staple sheet. The feeder includes front and rear feed rollers 330 and 331 made of butadiene-acrylonitrile rubber or the like and disposed between the center and front end of the magazine 320, and a drive means which is for turning the rollers but is not shown in the drawings.

To feed the staple sheet 302 forward out of the cartridge 301 by the feeder, the drive means is put into action to turn the feed rollers 330 and 331. Since the lowermost staple sheet 302*a* receives both the weight of the other stacked staple sheets thereon and the pushing force of the helical spring 316, a high frictional force acts between the lowermost staple sheet and the rear feed rollers 331. For that reason, the lowermost staple sheet 302*a* is moved forward out of the housing body 303 through the outlet port 305 as the rear feed rollers 331 are turned. The staple sheet 302*a* is then fed forward by the front feed rollers 330.

A forming and driving-out means, by which the staples of the staple sheet 302*a* fed by the feed rollers 330 and 331 are sequentially bent as U and then driven out toward a stapled material, starting with the foremost staple, and a drive mechanism for running the forming and driving-out means on the basis of the power of an electric motor are provided at or near the front end of the magazine 320. Since the cartridge 301 is set in the housing body 303 so as not to be displaced relative thereto by the mechanical vibration, the foremost staple of the fed staple sheet is unlikely to tumble and can therefore be securely driven. Since the forming and driving-out means and the drive mechanism do not directly pertain to the essentials of the present device, the means and the mechanism are not described in detail herein.

The mechanism provided in accordance with the present device acts so that the cartridge is engaged with the magazine at the bottom of the front part of the cartridge and the top of the rear part thereof and urged obliquely downward and forward by the elastic means. For that reason, the cartridge is firmly fixed at the front part thereof to the engagement part of the magazine by the mechanism so as not to play. At a result, the cartridge does not loosen at the staple forming and driving-out portion of the stapler while being fitted to the magazine. Since the cartridge is thus firmly fixed to the magazine by the mechanism so as not to be displaced relative to the magazine due to a mechanical vibration, the foremost staple of the move-out staple sheet is unlikely to tumble and can therefore be securely formed and driven out.

FIFTH EMBODIMENT

A fifth embodiment of the present device is hereafter described with reference to the drawings attached hereto.

Figure 18:
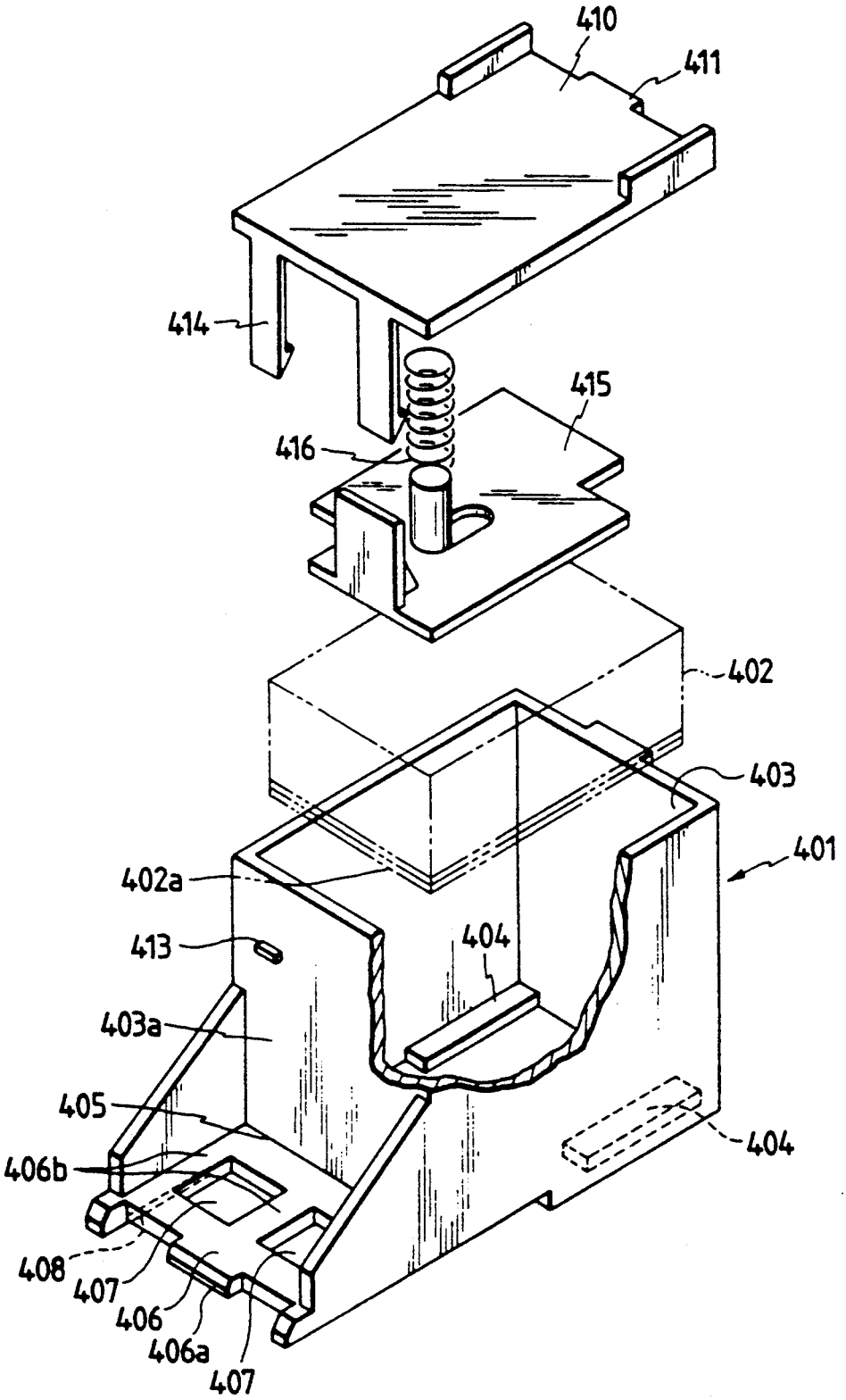
FIG. 18 is a perspective view of a cartridge which is a fifth embodiment of the present device.
Figure 19:
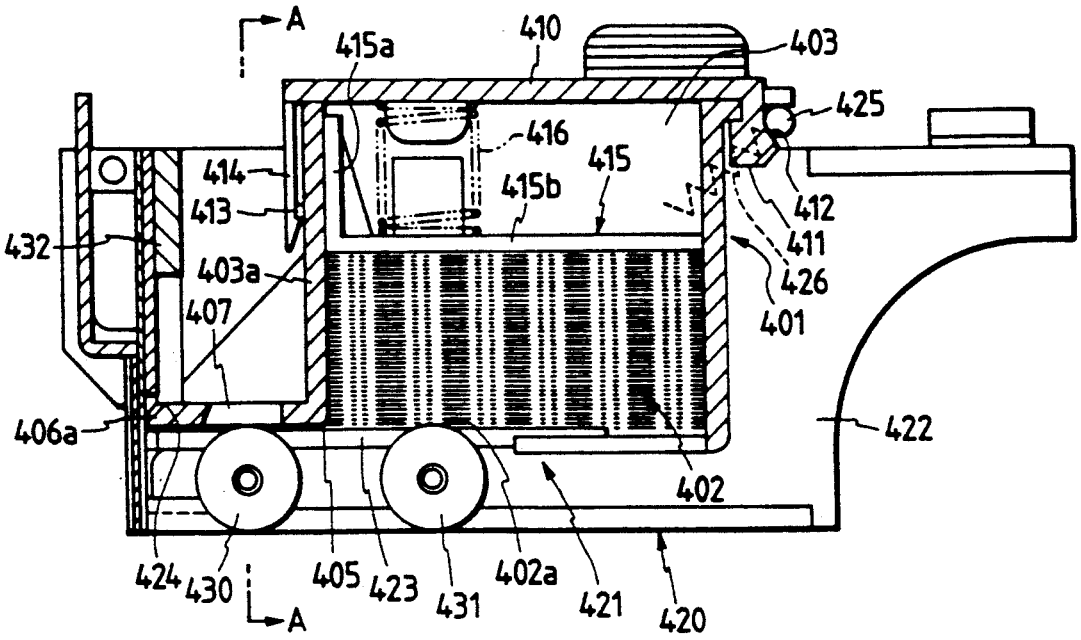
FIG. 19 is a sectional view of the cartridge fitted to the magazine of an electric stapler.

Shown at 401 in FIGS. 18 and 19 is a cartridge which is for an electric stapler and is the embodiment. Staple sheets 402 each consisting of straight staples conjoined together are housed in a stacked state in the cartridge 401. The cartridge 401 includes a staple sheet housing body 403, support strips 404, an outlet port 405, and a guide portion 406. The housing body 403 is open at the front of the bottom of the body. The support strips 404 are provided on the inner surfaces of both the side walls of the housing body at the rear portions of the walls so as to support the lowermost staple sheet 402*a* at both the side edges thereof in the body. The outlet port 405 is provided at the bottom of the front wall 403*a* of the housing body 403 so that the lowermost staple sheet 402*a* is moved forward out of the body through the outlet port. The guide portion 406 projects forward from the outlet port 405 so as to guide the moved-out staple sheet 402*a* at the top thereof. The guide portion 406 has a right and a left openings 407 at a distance from each other, and hanging parts 408 at the bottoms of both the sides of the portion. The height of each of the hanging parts 408 is slightly larger than the thickness of the staple sheet 402. The hanging parts 408 extend continuously from the bottom of the opening of the housing body 403. The front end 406*a* of the guide portion 406 is chamfered at an acute angle.

The cartridge 401 also includes a lid 410, a push member 415, and a helical spring 416. The lid 410 has an engagement projection 411 at the rear end of the lid so that the projection is engaged with the bent top portion of the housing body 403. The rear of the projection 411 has a bar support surface 412. The lid 410 has engagement hangers 414 extending down from the front end of the lid so that the hangers are engaged with projections 413 provided on the front wall 403*a* of the housing body 403. The helical spring 416 is provided between the lid 410 and the push member 415 near their front ends to always push down the staple sheets 402 set in the housing body 403.

Figure 20:
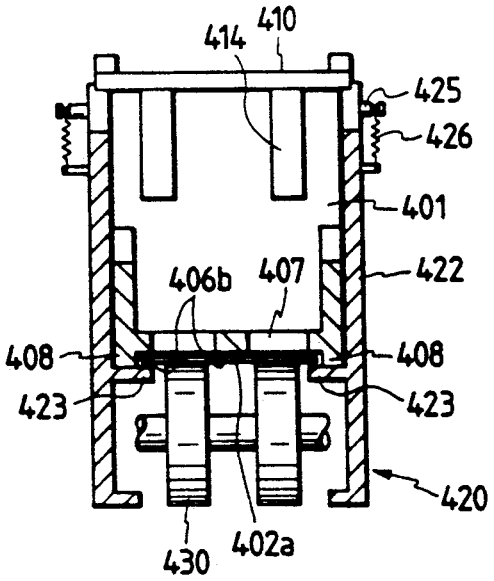
FIG. 20 is a sectional view of the cartridge along a line A—A shown in FIG. 19.

As shown in FIGS. 19 and 20, the cartridge 401 is removably attached to the magazine 420 of the electric stapler. The magazine 420 has a central fitting portion 421 to which the cartridge 401 housing the staple sheets 402 is fitted. The fitting portion 421 has support projections 423 extending inward from the lower portions of the side walls 422 of the magazine 420, an engagement opening 424 provided between the bottom of the front portion 432 of the magazine and the front ends of the support projections, and a hold-down bar 425 provided near the tops of the rear portions of the side walls of the magazine so that the bar can be slid on the tops of the side walls. The bar 425 is urged obliquely downward and forward by springs 426.

To fit the cartridge 401 to the fitting portion 421 of the magazine 420, the front end 406*a* of the guide portion 406 of the cartridge 401 is engaged in the engagement opening 424 of the magazine and the cartridge 401 is then strongly pushed downward at the rear portion thereof so that the hold-down bar 425 is moved back against the forces of the springs 426 and engaged on the bar support surface 412 of the cartridge. At that time, the cartridge 401 is supported at the bottom thereof by the support projections 423 on the side walls 422 of the magazine 420. The cartridge 401 can be easily removed form the fitting portion 421 of the magazine 420 if the cartridge is pulled up so that the hold-down bar 425 is moved back against the forces of the springs 426.

A feeder is provided at the lower portion of the magazine 420 so that the staple sheets 402 in the cartridge 401 are sequentially fed forward out of it by the feeder, starting with the lowermost staple sheet. The feeder includes front and rear feed rollers 430 and 431 made of NBR (butadiene-acrylonitrile rubber) or the like and disposed between the center and front end of the magazine, and a drive means which is for turning the rollers. The feed rollers 430 and 431 are right and a left front feed rollers 430, and a right and a left rear feed rollers 431. The front feed rollers 430 are in positions corresponding to those of the openings 407 of the guide portion 406 of the cartridge 401 fitted to the cartridge fitting portion 421 of the magazine 420, so that the distance between each front feed roller and the guide portion 406 is smaller than the thickness of the staple sheet 402. The rear feed rollers 431 are in such position that the tops of the rollers are located at the opening of the bottom of the cartridge 401, correspond to the helical spring 416 for pushing the staple sheets 402 in the cartridge, and are in pressure contract with the bottom of the lowermost staple sheet 402*a*.

Figure 21:
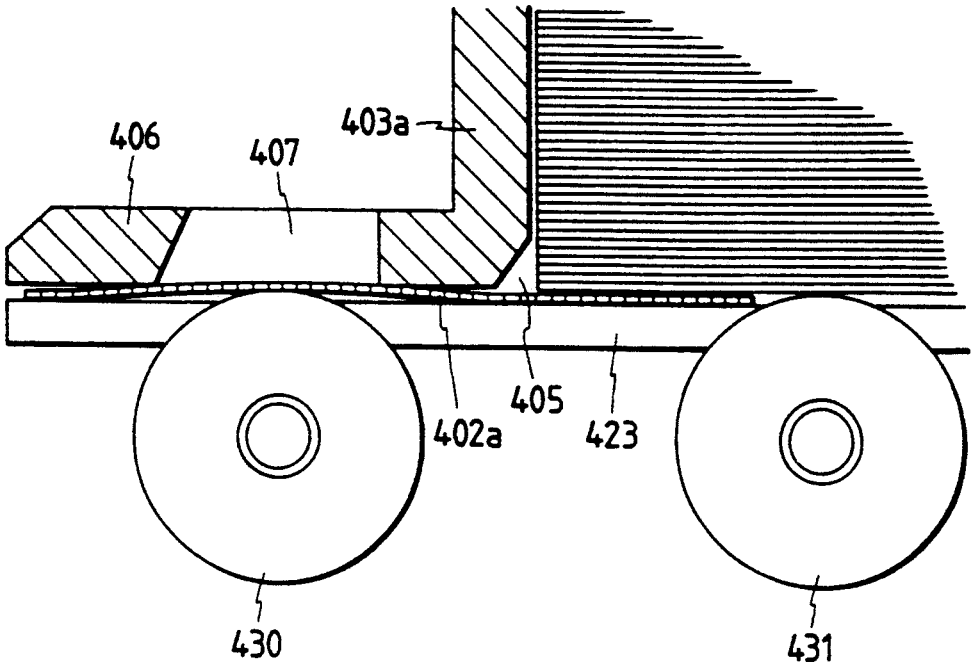
FIG. 21 is a view of the stapler of illustrate how a staple sheet is fed.

To feed the staple sheet 402 forward out of the cartridge 401 by the feeder, the drive means is put into action to turn the feed rollers 430 and 431. Since the lowermost staple sheet 402*a* receives both the weight of the other stacked staple sheets thereon and the pushing force of the helical spring 416, a high frictional force acts between the lowermost staple sheet and the rear feed rollers 431 so that the lowermost staple sheet is moved forward out of the housing body 403 through the outlet port 405 as the rear feed rollers are turned. At the time of the feeding, the staple sheet 402*a* is supported at both the side edges thereof by the inner surfaces of the hanging parts 408 of the guide portion 406 of the cartridge 401 and supported at the bottom of the sheet by the support projections 423 on the side walls 422 of the magazine 420. When the staple sheet 402*a* has come into contact with the front feed rollers 430, the sheet begins to be fed forward by the rollers due to the frictional forces between the sheet and the rollers, as shown in FIG. 21. At that time, the staple sheet 402*a* is pushed toward the openings 407 of the guide portion 406 at the roller contact portion of the sheet so that the parts 406*b* of the guide portion, which are a part between the right and the left openings 407 and parts at the outer side edges of the openings as shown in FIG. 20, push the staple sheet downward as reaction. As a result, the frictional forces between the bottom of the staple sheet 402*a* and the front feed rollers 430 are high, but a frictional resistance does not act to the sliding of the portions of the top of the sheet, which correspond to the openings 407 of the guide portion 406, so that the feeding power of the front feed rollers 430 for the staple sheet is not reduced by the resistance. For that reason, the staple sheet 402*a* is securely fed by the feeder. Besides, since a part of the roller contact portion of the sheet 402*a* is supported by the bottom of the guide portion 406 in contact therewith, the roller contact portion is hardly deformed although it comes into pressure contact with the front feed rollers 430. For that reason, the staple sheet 402*a* is unlikely to be deformed so that the sheet is broken into parts during the feeding of the sheet.

Although the guide portion 406 has the openings 407 in the embodiment, the present device is not confined thereto but may be other wise embodied so that the guide portion has, instead of the openings, such recesses in the bottom of the portion that the top of the staple sheet does not come into contact with the surfaces in the recesses.

The electric stapler has a forming means, a staple driver, and a drive mechanism at or near the front end of the magazine 420, similarly to that disclosed in the Japanese Utility Model Examined Publication No. 34854/88. The staples of the staple sheet 402*a* fed to the forming means by the feeder are sequentially bent as U by the forming means, starting with the foremost of the staples. The staple bent as U by the forming means is driven out toward a stapled material by the driver. The forming means and the driver are run by the drive mechanism on the basis of the motive power of an electric motor. Since the forming means, the driver and the drive mechanism do not directly pertain to the essentials of the present device, the means, the driver and the mechanism are not described in detail herein.

SIXTH EMBODIMENT

A sixth embodiment of the present device is hereafter described reference to the drawings attached hereto.

Figure 22:
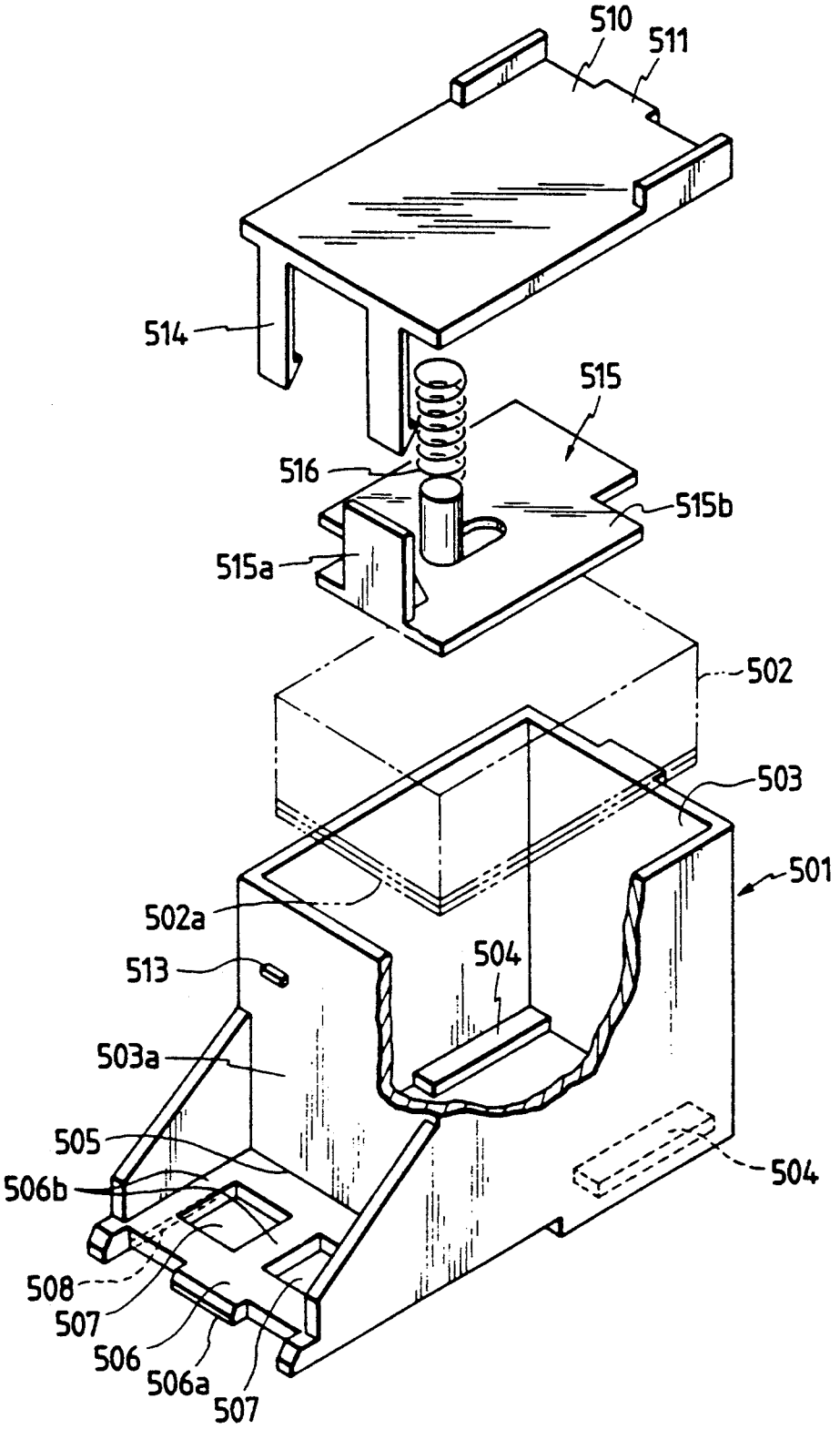
FIG. 22 is a perspective view of a cartridge which is a sixth embodiment of the present device.
Figure 23:
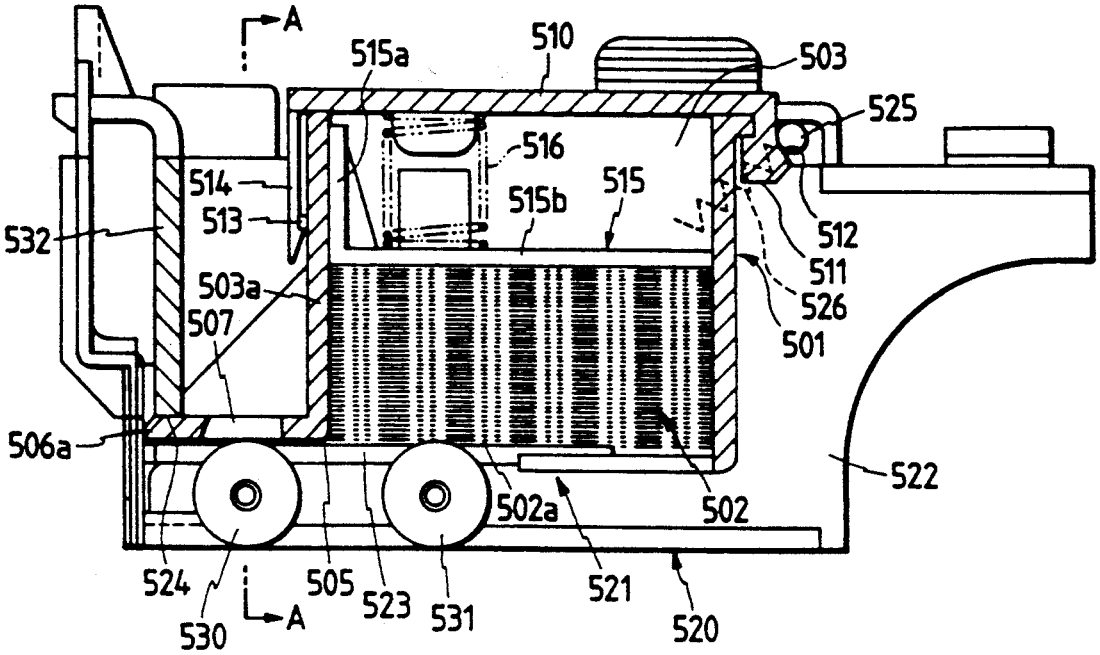
FIG. 23 is a sectional view of the cartridge fitted to the magazine of an electric stapler.

Shown at 501 in FIGS. 22 and 23 is a cartridge which is for an electric stapler and is the embodiment. Staple sheets 502 each consisting of straight staples conjoined together are housed in a stacked state in the cartridge 501. The cartridge 501 includes a staple sheet housing body 503, support strips 504, an outlet port 505, and a guide portion 506. The housing body 503 is open at the front of the bottom of the body. The support strips 504 are provided on the inner surfaces of both the side walls of the housing body at the rear portions of the walls so as to support the lowermost staple sheet 502*a* at both the side edges thereof in the body. The outlet port 505 is provided at the bottom of the front wall 503*a* of the housing body 503 so that the lowermost staple sheet 502*a* is moved forward out of the body through the outlet port. The guide portion 506 projects forward from the outlet port 505 so as to guide the moved-out staple sheet 502*a* at the top thereof. The guide portion 506 has right and left openings 507 at a distance from each other, and hanging parts 508 at the bottoms of both the sides of the portion. The height of each of the hanging parts 508 is slightly larger than the thickness of the staple sheet 502. The hanging parts 508 extend continuously from the bottom of the opening of the housing body 503. The front end 506*a* of the guide portion 506 is chamfered at an acute angle.

The cartridge 501 also includes a lid 510, a push member 515, and a helical spring 516. The lid 510 has an engagement projection 511 at the rear end of the lid so that the projection is engaged with the bent top portion of the housing body 503. The rear of the projection 511 has engagement hangers 514 extending down from the front end of the lid so that the hangers are engaged with projections 513 provided on the front wall 503*a* of the housing body 503. The push member 515 is provided in the housing body 503 of the cartridge 501. The push member is shaped as L, and includes a wall portion 515*a* located in contact with the inner surface of the front wall 503*a* of the housing body 503, and a floor portion 515*b* located in contact with the top of the uppermost of the staple sheets 502 in the housing body. The helical spring 516 is provided between the lid 510 and the floor portion 515*b*. The surface area of the top of the floor portion 515*b* is nearly equal to the inner cross-sectional area of the housing body 503. The helical spring 516 is disposed near the front end of the floor portion 515*b* so that the force of the spring acts to the floor portion near the front end thereof. As a result, the staple sheets 502 stacked together in the housing body 503 are always pushed downward, particularly near the front ends of the sheets. For that reason, even if each of the staple sheets 502 has a warp, the sheet is flattened, particularly nearly the front end thereof. The wall portion 515*a* acts to always keep the floor portion 515*b* nearly horizontal. Since the support strips 504 for supporting the staple sheets 502 in the housing body 503 under the sheets are located at the rear portion of the housing body and the body is open in front of the support strips, the staple sheets would be pushed down at the front portions thereof through the front portion of the bottom of the housing body by the push member 515 under the force of the helical spring 516. A force for feeding the lowermost staple sheet acts to only the mutual contact parts of the sheet and each roller of the feed means of the electric stapler. For that reason, at least one roller of the feed means needs to be located near the front of the bottom of the cartridge.

Figure 24:
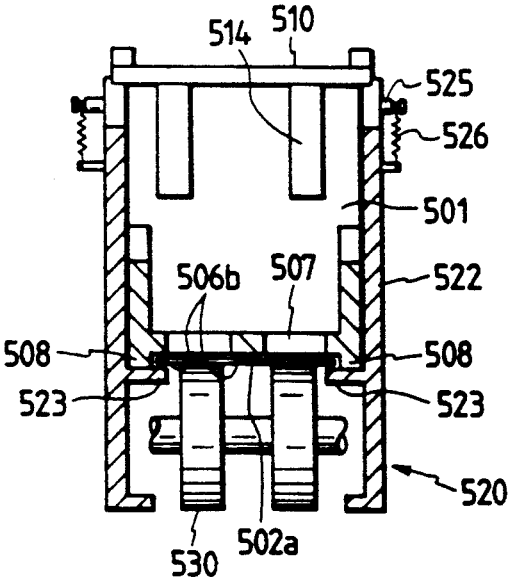
FIG. 24 is a sectional view of the cartridge along a line A—A shown in FIG. 23.

As shown in FIGS. 23 and 24, the cartridge 501 is removably attached to the magazine 520 of the electric stapler. The magazine 520 has a central fitting portion 521 to which the cartridge 501 housing the staple sheets 502 is fitted. The fitting portion 521 has support projections 523 extending inward from the lower portions of the side walls 522 of the magazine 520, an engagement opening 524 provided between the bottom of the front portion 532 of the magazine and the front ends of the support projections, and a hold-down bar 525 provided near the tops of the rear portions of the side walls of the magazine so that the bar can be slid on the tops of the side walls. The bar 525 is urged obliquely downward and forward by springs 526.

To fit the cartridge 501 to the fitting portion 521 of the magazine 520, the front end 506*a* of the guide portion 506 of the cartridge 501 is engaged in the engagement opening 524 of the magazine and the cartridge 501 is then strongly pushed downward at the rear portion thereof so that the hold-down bar 525 is moved back against the forces of the springs 526 and engaged on the bar support surface 512 of the cartridge. At that time, the cartridge 501 is supported at the bottom thereof by the support projections 523 on the side walls 522 of the magazine 520. The cartridge 501 can be easily removed from the fitting portion 521 of the magazine 520 if the cartridge is pulled up so that the hold-down bar 525 is moved back against the forces of the springs 526.

A feeder is provided at the lower portion of the magazine 520 so that the staple sheets 502 in the cartridge 501 are sequentially fed forward out of it by the feeder, starting with the lowermost staple sheet. The feeder includes front and rear feed rollers 530 and 531 made of butadiene-acrylonitrile rubber or the like and disposed between the center and front end of the magazine, and a drive means which is for turning the rollers but is not shown in the drawings. The feed rollers 530 and 531 are right and a left front feed rollers 530, and a right and a left rear feed rollers 531. The front feed rollers 530 are in positions corresponding to those of the openings 507 of the guide portion 506 of the cartridge 501 fitted to the cartridge fitting portion 521 of the magazine 520, so that the distance between each front feed roller and the guide portion 506 is smaller than the thickness of the staple sheet 502. The rear feed rollers 531 are in such position that the tops of the rollers are located at the opening of the bottom of the cartridge 501, correspond to the helical spring 516 for pushing the staple sheets 502 in the cartridge, and are in pressure contract with the bottom of the lowermost staple sheet 502*a*.

Figure 25:
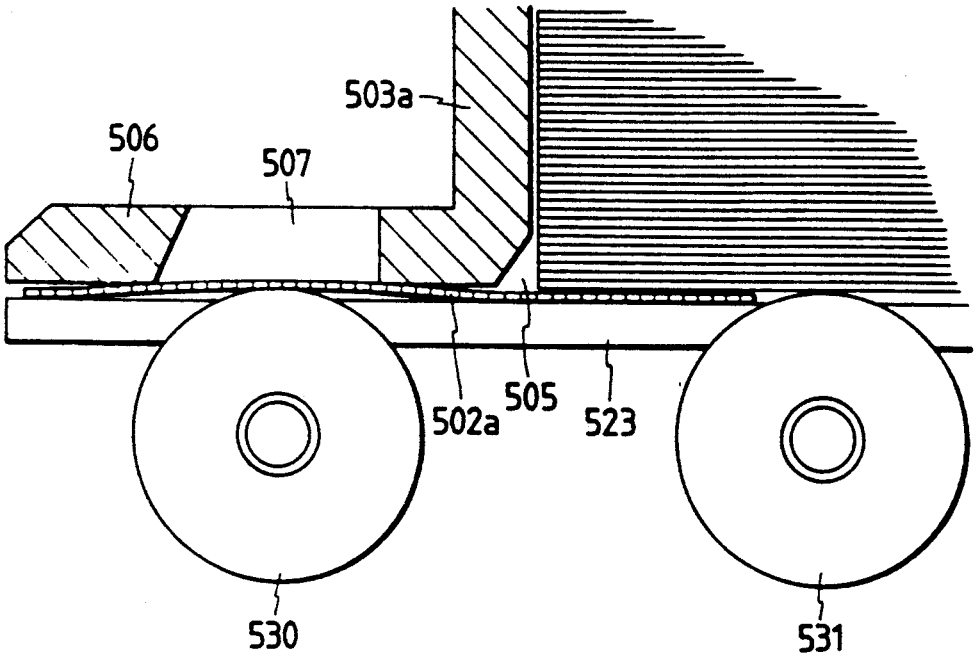
FIG. 25 is a view of the stapler to illustrate how a staple sheet is fed.

To feed the staple sheet 502 forward out of the cartridge 501 by the feeder, the drive means is put into action to turn the feed rollers 530 and 531. Since the lowermost staple sheet 502*a* receives both the weight of the other stacked staple sheets thereon and the pushing force of the helical spring 516, a high frictional force acts between the lowermost staple sheet and the rear feed rollers 531. Besides, since the staple sheets 502 are pushed downward, particularly at the front portions thereof, by the push member 515 and the helical spring 516, each staple sheet is flattened at the front portion thereof even if the sheet has a warp. For that reason, the lowermost moved-out staple sheet. 502*a*, is securely and smoothly moved forward out of the housing body 503 through the outlet port 505 as the rear feed rollers 531 are turned. At that time, the staple sheet 502*a* is supported at both the side edges thereof by the inner surfaces of the hanging parts 508 of the guide portion 506 of the cartridge 501 and supported at the bottom of the sheet by the support projections 523 on the side walls 522 of the magazine 520. When the moved-out staple sheet 502*a* has come into contact with the front feed rollers 530, the sheet begins to be fed forward by the rollers due to the frictional forces between the sheet and the rollers, as shown in FIG. 25. At that time, the staple sheet 502*a* is pushed toward the openings 507 of the guide portion 506 at the roller contact portion of the sheet so that the parts 506*b* of the guide portion, which are a part between the right and the left openings 507 and parts at the outer side edges of the openings as shown in FIG. 24, push the staple sheet downward as reaction. As a result, the frictional forces between the bottom of the staple sheet 502*a* and the front feed rollers 530 are high, but a frictional resistance does not act to the sliding of the portions of the top of the sheet, which correspond to the openings 507 of the guide portion 506, so that the feeding power of the front feed rollers 530 for the staple sheet is not reduced by the resistance. For that reason, the moved-out staple sheet 502*a* is secured fed by the feeder.

The electric stapler has a forming means, a staple driver, and a drive mechanism at or near the front end of the magazine 520, similarly to that disclosed in the Japanese Utility Model Examined publication No. 34854/88. The staples of the staple sheet 502*a* fed to the forming means by the feeder are sequentially bent as U by the forming means, starting with the foremost of the staples. The staple bent as U by the forming means is driven out toward a stapled material by the driver. The forming means and the driver are run by the drive mechanism on the basis of the motive power of an electric motor. Since the forming means, the driver and the drive mechanism do not directly pertain to the essentials of the present device, the means, the driver and the mechanism are not described in detail herein.

What is claimed is:

1. An electric stapler comprising:

a body frame;

a magazine fixedly secured to said body frame;

a cartridge housing a plurality of staple sheets, each of said staple sheets including straight staples conjoined together in a stacked state, said cartridge being coupled to said magazine;

a driver for driving a staple out of one of said staple sheets, said driver being supported by said magazine so that said driver can be rectilinearly reciprocated;

means for clinching said staple driven out by said driver, said clinching means being supported by said body frame so as to be reciprocated; and means for repeatedly moving said driver and said clinching means toward and away from each other in mutually opposite directions nearly simultaneously; said magazine comprising means for engaging a front portion of said magazine with a guide portion of said stapler; and means for engaging a top of a rear portion of said cartridge so as to urge said cartridge obliquely downward and forward.

2. An electric stapler comprising:

a body frame;

a magazine fixedly secured to said body frame;

a cartridge housing a plurality of staple sheets, each of said staple sheets including straight staples conjoined together in stacked state, said cartridge being coupled to said magazine;

a driver for driving a staple out of one of said staple sheets, said driver being supported by said magazine so that said driver can be rectilinearly reciprocated;

means for clinching said staple driven out by said driver, said clinching means being supported by said body frame so that said clinching means is located to face said driver and can be reciprocated;

means for repeatedly moving said driver and said clinching means toward and away from each other in mutually opposite directions nearly simultaneously; and means for detecting an existence of said staple sheets housed in said cartridge, said detecting means including a detection switch provided at said magazine and located in a position corresponding to that of an opening formed at the bottom of said cartridge and a switching lever attached to said detection switch, said switching lever including a tip portion, said tip portion so positioned that said detector switch is not actuated in response to a displacement of said tip portion when said displacement is not more than the approximate thickness of said staple sheet; and wherein said switching lever can be displaced along the direction of the feed of said sheet.

* * * * *